US010718122B2

(12) United States Patent
Gooden

(10) Patent No.: US 10,718,122 B2
(45) **Date of Patent: *Jul. 21, 2020**

(54) STRUCTURAL CELLS, MATRICES AND METHODS OF ASSEMBLY

(71) Applicant: STRATA INNOVATIONS PTY LIMITED, Singleton, New South Wales (AU)

(72) Inventor: Benjamin Douglas Gooden, Singleton (AU)

(73) Assignee: STRATA INNOVATIONS PTY LIMITED, Singleton, New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/540,047

(22) Filed: Aug. 13, 2019

(65) Prior Publication Data

US 2019/0383043 A1 Dec. 19, 2019

Related U.S. Application Data

(63) Continuation of application No. 15/811,043, filed on Nov. 13, 2017, now Pat. No. 10,415,260.

(51) Int. Cl.
*E04G 11/48* (2006.01)
*E01C 11/18* (2006.01)
(Continued)

(52) U.S. Cl.
CPC ..... *E04G 11/48* (2013.01); *E01C 3/006* (2013.01); *E01C 3/06* (2013.01); *E01C 9/004* (2013.01); *E01C 11/18* (2013.01); *E01C 11/185* (2013.01); *E01C 11/226* (2013.01); *E03F 1/002* (2013.01); *E04G 9/05* (2013.01); *E04G 17/02* (2013.01); *E01F 5/00* (2013.01); *E04B 5/326* (2013.01); *E04F 15/02417* (2013.01)

(58) Field of Classification Search
CPC ..... E02D 27/00; E03F 1/002; E01C 9/005
USPC ..... 404/28, 31, 37
See application file for complete search history.

(56) References Cited

U.S. PATENT DOCUMENTS 2,327,640 A * 8/1943 Hendry ..... E01C 9/086 404/36
2,375,454 A * 5/1945 Wichert ..... E01C 9/083 404/36

(Continued)

*Primary Examiner* — Abigail A Risic
(74) *Attorney, Agent, or Firm* — William H. Honaker; Dickinson Wright PLLC

(57) ABSTRACT

Structural cells and matrices using the structural cells for positioning below a hardscape that define a void space therein, the structural cells, matrices using the cells and methods of assembly allowing in one embodiment the introduction of a structural fluid such as concrete to provide an alternative structural cell and matrix product. In one embodiment a structural cell assembly is described comprising a structural cell with a plurality of legs integrally linked to a frame at a first frame end, the frame linking the legs together and the frame defining a generally flat plane with the legs extending substantially orthogonally away from the first frame end about the frame flat plane to a leg terminal end; and a separate plate engaging the legs, the separate plate comprising linked sockets, each socket engaging the leg terminal end; and/or linked sockets, each socket engaging the leg frame ends or a part thereof.

16 Claims, 12 Drawing Sheets

(51) Int. Cl.

| | |
|---|---|
| ***E01C 11/22*** | (2006.01) |
| ***E01C 3/00*** | (2006.01) |
| ***E03F 1/00*** | (2006.01) |
| ***E01C 3/06*** | (2006.01) |
| ***E01C 9/00*** | (2006.01) |
| ***E04G 9/05*** | (2006.01) |
| ***E04G 17/02*** | (2006.01) |
| ***E01F 5/00*** | (2006.01) |
| *E04B 5/32* | (2006.01) |
| *E04F 15/024* | (2006.01) |

(56) References Cited

U.S. PATENT DOCUMENTS 2,394,713 A * 2/1946 Nagin ..... E04C 2/423 52/581
3,802,790 A * 4/1974 Blackburn ..... E01C 7/14 404/82
4,478,901 A * 10/1984 Dickens ..... A47G 27/0212 404/36
5,123,778 A * 6/1992 Bohnhoff ..... E01C 11/165 404/28
5,460,867 A * 10/1995 Magnuson ..... E01C 13/08 405/36
5,848,856 A * 12/1998 Bohnhoff ..... E02B 11/00 405/36
6,428,870 B1 * 8/2002 Bohnhoff ..... E02B 11/00 405/50
6,585,449 B2 * 7/2003 Chen ..... E01C 11/18 404/2
6,962,464 B1 * 11/2005 Chen ..... E01C 11/226 405/43
7,201,538 B2 * 4/2007 Blackwood ..... E01C 13/083 404/36
7,704,011 B2 * 4/2010 Marshall ..... E01C 3/006 404/29
7,771,814 B2 * 8/2010 Grimble ..... B27N 5/00 249/16
8,267,618 B2 * 9/2012 Chen ..... E01C 3/003 404/17
8,353,640 B2 * 1/2013 Sawyer ..... E01C 11/225 404/4
8,555,586 B2 * 10/2013 Lowe ..... E03F 1/005 210/170.03
8,596,903 B2 * 12/2013 Hur ..... E01F 15/146 404/6
8,608,401 B2 * 12/2013 Gooden ..... A01G 13/0237 404/40
8,683,769 B2 * 4/2014 Cerny ..... E01C 5/001 404/36
8,696,241 B2 * 4/2014 Lee ..... E01C 13/083 405/39
9,303,365 B2 * 4/2016 Gooden ..... A01G 13/0237
9,506,235 B2 * 11/2016 Adams ..... E03F 3/046
9,775,303 B2 * 10/2017 Ray ..... A01G 13/0237
9,775,304 B2 * 10/2017 Gooden ..... A01G 13/0237
2005/0117969 A1 * 6/2005 Byrne ..... B60R 3/00 404/19
2008/0113161 A1 * 5/2008 Grimble ..... B27N 5/00 428/174
2008/0115413 A1 * 5/2008 Blackmore ..... A01G 9/0295 47/65.7
2008/0166182 A1 * 7/2008 Smith ..... E03F 1/005 405/36
2009/0242731 A1 * 10/2009 Dinkins ..... E01C 9/001 249/83
2009/0250369 A1 * 10/2009 Guibert ..... E03F 1/002 206/507
2010/0260546 A1 * 10/2010 Blackwood ..... E02B 11/00 405/36
2011/0097151 A1 * 4/2011 Lee ..... E01C 13/083 405/39
2012/0020746 A1 * 1/2012 Astolfi ..... E02D 29/025 405/284
2012/0057932 A1 * 3/2012 Marshall ..... E01C 9/004 404/35
2012/0141203 A1 * 6/2012 Gooden ..... A01G 13/0237 404/41
2012/0163911 A1 * 6/2012 Culleton ..... E01C 5/22 404/41
2012/0255624 A1 * 10/2012 Canney ..... E02B 11/005 137/315.01
2014/0270945 A1 * 9/2014 Bach ..... E01C 5/20 404/36
2015/0016874 A1 * 1/2015 Wandkowski ..... E03F 1/005 403/292

* cited by examiner

STRUCTURAL CELLS, MATRICES AND METHODS OF ASSEMBLY

CROSS REFERENCE TO RELATED APPLICATION

This application is a continuation of U.S. patent application Ser. No. 15/811,043 filed on Nov. 13, 2017 which is incorporated herein in their entirety.

TECHNICAL FIELD

Described herein are improvements in structural cells, matrices and methods of assembly. More specifically, structural cells and matrices using the structural cells are described for positioning below a hardscape that define a void space therein, the structural cells, matrices using the cells and methods of assembly allowing in one embodiment the introduction of a structural fluid such as concrete in a part of parts of the cell to alter the structural cell and matrix product characteristics.

BACKGROUND ART

Structural cells for under hardscapes that support a compressive load have been used for a number of years now. Art products are typically plastic mouldings using spaced apart legs and a base, top or other retraining structure to align the legs. The legs take up compressive loading on the cell allowing the void space inside the cell to be used for applications such as tree root growth in uncompacted soil or, water reservoir use where the void space is used to capture and retain storm water. There can also be other uses for structural cells or matrices using the structural cells where void space is needed in order to fill a volume and where some degree of structural strength and integrity is required—one example might be in the construction of roadside berms where structural cell matrices may provide an alternative to transporting and delivery of significant volumes of infill.

One drawback of existing designs may be complexity. Another drawback may be in cost. A further drawback may be in structural strength achieved from plastic. Another drawback may be a perceived lack of structural capability in civil and structural applications from a material like plastic. A further drawback may be that of plastic deflection whereby plastic art cells may move elastically when placed under load which is an issue when brittle or non-elastic materials are coupled with the cells and matrices.

The structural cells, matrices and methods of assembly described herein attempt to address at least some of the above drawbacks or at least provide the public with a choice.

Further aspects and advantages of the structural cells, matrices and methods of assembly will become apparent from the ensuing description that is given by way of example only.

SUMMARY

Structural cells and matrices using the structural cells are described herein for positioning below a hardscape that define a void space therein, the structural cells, matrices using the cells and, methods of assembly, allowing in one embodiment the introduction of a structural fluid such as concrete to provide an alternative structural cell and matrix product.

In a first aspect, there is provided a structural cell assembly, the assembly comprising:

a structural cell with a plurality of legs integrally linked to a frame at a first frame end, the frame linking the legs together and the frame defining a generally flat plane with the legs extending substantially orthogonally away from the first frame end to a leg terminal end; and a separate plate engaging the legs, the separate plate comprising:

linked sockets, each socket engaging the leg terminal end; and/or linked sockets, each socket engaging the leg frame ends or a part thereof.

In a second aspect, there is provided a structural cell formwork that is configured to receive and retain a structural fluid therein, the structural cell comprising:

a plurality of hollow legs integrally linked to a frame at a first frame end, the frame linking the legs together and the frame defining a generally flat plane with the legs extending substantially orthogonally away from the first frame end to a leg terminal end; and wherein the frame and hollow leg interior collectively define an internal void space that receives and retains a structural fluid placed therein.

In a third aspect, there is provided a load bearing matrix comprising:

a plurality of structural cells aligned vertically and/or horizontally; and a plurality of separate plates, each separate plate being approximately the same width and length as each structural cell, the separate plates located on top of the plurality of structural cells and/or below the plurality of structural cells; and wherein each structural cell comprises a plurality of legs integrally linked to a frame at a first leg frame end, the frame defining a generally flat plane with the legs extending substantially orthogonally away from the first leg frame end to a leg terminal end; and wherein each separate plate comprises plate sockets linked together via lateral connectors that engage with either an opening in the first leg frame end of a first structural cell, or the leg terminal end of a second structural cell.

In a fourth aspect, there is provided a structural cell formed from hardened structural fluid, the structural cell comprising:

a plurality of solid legs linked to a frame at a first frame end, the frame defining a generally flat plane with the legs extending substantially orthogonally away from the first frame end to a leg terminal end; and wherein the structural cell defines a free void space therein, the free void space defined by the frame width and depth and the leg height, less any space used within this volume for the legs or frame parts.

In a fifth aspect, there is provided a load bearing matrix comprising:

a plurality of structural cells stacked vertically and/or horizontally wherein each structural cell is formed as one element from hardened structural fluid, each structural cell comprising:

a plurality of solid legs linked to a frame at a first frame end, the frame defining a generally flat plane with the legs extending substantially orthogonally away from the first frame end to a leg terminal end; and wherein the structural cell defines a free void space therein, the free void space defined by the frame width and depth and the leg height, less any space used within this volume for the legs or frame parts.

In a sixth aspect, there is provided a method of forming a load bearing matrix, the method comprising the steps of:

select at least one structural cell substantially as described above and a substrate on which the load bearing matrix will be formed;

place separate plates on the substrate;

place a first layer of structural cells on the separate plates;

repeat placing of structural cell layers vertically until the desired matrix height is reached;

place separate plates on top of the final structural cell layer; and optionally, placing a load on the matrix.

Advantages of the above may include elimination of deflection of the legs or other cell parts when the cell or matrix of cells are subjected to a compressive load. Deflection using art products may be very low but this still may be of some importance when used beneath pavements subjected to unrestricted or dynamic vertical loads. The structural cell described may better withstand compressive loads and may be filled with a structural fluid like concrete in order to completely prevent any vertical deflection at all. Concrete in particular may represent a useful structural fluid since it is well understood and widely used and accepted in structural applications.

BRIEF DESCRIPTION OF THE DRAWINGS

Further aspects of the structural cells, matrices and methods of assembly will become apparent from the following description that is given by way of example only and with reference to the accompanying drawings in which.

DETAILED DESCRIPTION

Figure 1:
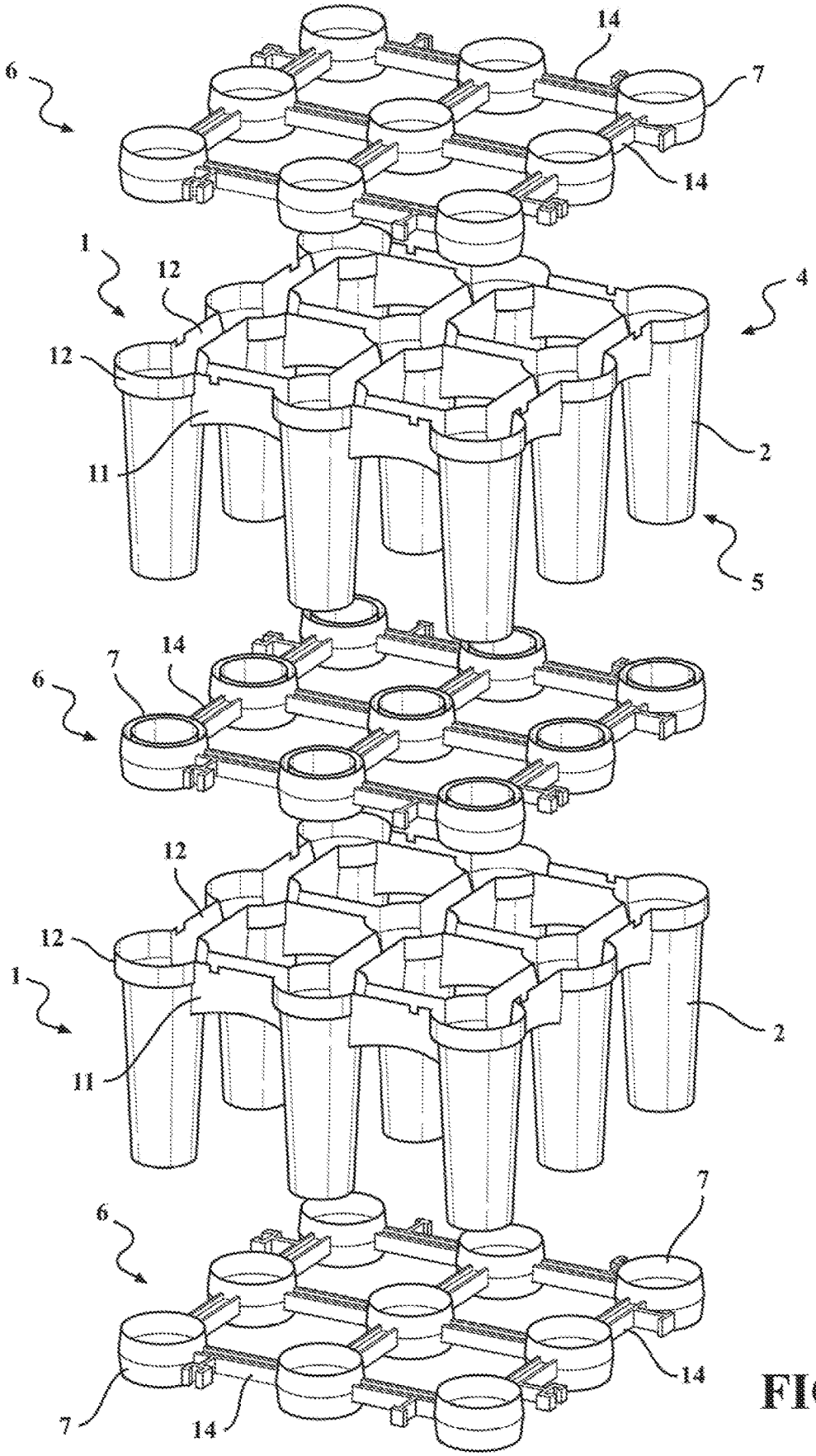
FIG. 1 illustrates an exploded perspective view of one configuration of structural cell matrix.

As noted above, described herein are structural cells and matrices using the structural cells for positioning below a hardscape that define a void space therein, the structural cells, matrices using the cells, and methods of assembly, allowing in one embodiment the introduction of a structural fluid such as concrete to provide an alternative structural cell and matrix product.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

The term 'cell' and 'structural cell' and grammatical variations thereof are used interchangeably and reference to one or the other should not be seen as limiting.

The term 'matrix' and grammatical variations thereof refers to multiple structural cell aligned in a horizontal plane, aligned in a vertical plane and/or aligned in both a horizontal and vertical plane.

Structural Cell Assembly

In a first aspect, there is provided a structural cell assembly, the assembly comprising:

a structural cell with a plurality of legs integrally linked to a frame at a first frame end, the frame linking the legs together and the frame defining a generally flat plane with the legs extending substantially orthogonally away from the first frame end to a leg terminal end; and a separate plate engaging the legs, the separate plate comprising:

linked sockets, each socket engaging the leg terminal end; and/or linked sockets, each socket engaging the leg frame ends or a part thereof.

Structural Characteristics

The structural cell may resist a compressive load imposed about the leg longitudinal axis or plurality of leg axes.

The structural cell absent of any structural fluid (described in more detail below) may have a crush resistance or compressive strength of at least approximately 100, or 125, or 150, or 175, or 200, or 225, or 250, or 275, or 300, or 325, or 350, or 375, or 400, or 425, or 450, or 475, or 500, or 525, or 550, or 575, or 600 kPa. The structural cell described may have a compressive strength of greater than 150 kPa. Alternatively, the structural cell described may have a compressive strength of greater than 300 kPa. The exact compressive strength may depend on the final application—low load bearing applications may for example require minimal compressive strength while high load bearing applications, such as a roadway bearing heavy vehicles, may require significantly more compressive strength. The use or otherwise of a structural fluid in the cell (described further below) may also have some bearing on the compressive strength of the cell described herein. As described further below, the structural cell may have an additional structural fluid added and the structural cell itself may merely act to receive and retain the structural fluid, at least until hardening or setting, and may not itself provide any significant structural load capacity to the hardscape. In this embodiment, the structural cell itself may even have a compressive strength below 100 kPa. As may be appreciated, art structural cells may achieve similar (or lower) compressive strength however, the inventor has found that the material volume required to form the structural cells described herein is far more efficient relative to compressive strength. By way of example, the inventor has found that art structural cells which achieve compressive strengths of 150 kPa or 300 kPa using 10, or 15, or 20, or 25, or 30, or 35, or 40, or 45, or 50% more material volume than a similar structural cell described herein for the same compressive strength rating. This material volume (usually plastic) saving equates to significant cost benefits in terms of materials used to manufacture the cells and, also considerably faster manufacture (perhaps up to 20% faster manufacturing speed in the inventor's experience).

The compressive strength noted above may be measured by placing a structural cell between two steel plates of a similar or greater area as the cell width and depth. The steel plates used may typically be 20-30 mm thick. The steel plate weights may apply a fixed measurable force load/pressure to the cell between the steel plates. Additional force load/pressure may then be applied to the structural cell between the steel plates until at least partial collapse/plastic deformation of the structural cell occurs. The load or pressure at which collapse/plastic deformation occurs may be defined as being the compressive strength of the structural cell.

As may be appreciated, compressive strength as measured above is not a perfect measure of structural cell integrity as, at least a degree of elastic deformation may occur to the structural cell prior to collapse/plastic deformation. The true structural strength if elastic deformation is used as a primary measure, may in fact be 5, or 10, or 15, or 20, or 25, or 30% lower than the measured compressive strength at which collapse occurs. As a result, where deflection is to be avoided, the compressive strength of art plastic cells may be significantly overstated.

The structural cell described herein may be designed, even without a structural fluid, to minimise elastic deformation or deflection so that the structural cell resists elastic deformation/deflection up to a point around 20, or 15, or 10, or 5% below the final compressive strength when collapse/plastic deformation occurs. Whilst not wanting to be bound to theory, it is understood that at least in part, this additional resistance to deflection may be due to way the frame of the structural cell described herein is arranged relative to the legs and/or the circular/conical leg shape acting to efficiently transfer a load to the frame/cell.

The structural cell may at least partly bear the load of a hardscape placed on the structural cell.

The structural cell may at least partly bear a load applied by an object on a hardscape placed over the structural cell.

Alternatively, the structural cell may bear the load of a structural fluid poured therein.

Void Space

The overall structural cell shape may be substantially defined by the extent of the frame width, depth and the leg length. There may be no other items or parts present about the structural cell height other than the legs. When viewed side on, each structural cell may present unobstructed openings or void space completely through the structural cell between the legs.

The overall structural cell volume may be defined by a free void space, an internal void space and a portion of structural cell material itself.

The free void space may be the space defined by the frame width and depth and the leg height less any space used within this volume for the legs or frame parts and any internal void space within the legs and frame.

The internal void space may be defined by any volume of space within the legs or frame not accessible from within the free void space. As should be appreciated, none of the leg volume may be accessible from the free void space if the legs are continuous in form along their length, for example being solid legs or alternatively being hollow legs but without any openings accessible from inside the free void space. Alternatively, at least some of the leg volume may be accessible to the free void space if the leg or legs are hollow internally and if an opening existed in the leg sides for example. Either option may be possible depending on the desired end configuration and outcome.

The free void space may be at least approximately 75, or 76, or 77, or 78, or 79, or 80, or 81, or 82, or 83, or 84, or 85, or 86, or 87, or 88, or 89, or 90% of the overall structural cell volume. The structural cell free void space may be approximately 75-85%, or 80-85%, or 85-90% of the overall structural cell volume.

The internal void space may be at least approximately 1, or 2, or 3, or 4, or 5, or 6, or 7, or 8, or 9, or 10, or 11, or 12, or 13, or 14, or 15, or 16, or 17, or 18, or 19, or 20, or 21, or 22, or 23, or 24, or 25% of the overall structural cell volume. The structural cell internal void space may be approximately 15-25%, or 10-15%, or 5-10%, or 1-5% of the overall structural cell volume.

Number and Leg Configuration

The structural cell may have multiple legs, the legs arranged relative to each other in regular or even patterns that collectively spread a compressive load placed on the structural cell frame.

The structural cell may have two legs. The two legs may be arranged beside each other in a common vertical plane.

The structural cell may have three legs. The three legs may be arranged beside each other in a common vertical plane. The three legs may alternatively be arranged to form a triangular shape about a horizontal plane.

The structural cell may have four legs. The four legs may be arranged beside each other in a common vertical plane. The four legs may alternatively be arranged to form a square shape about a horizontal plane.

The structural cell may have five legs. The five legs may be arranged beside each other in a common vertical plane. The five legs may alternatively be arranged to form a pentagon shape about a horizontal plane.

The structural cell may have six legs. The six legs may be arranged beside each other in a common vertical plane. The six legs may alternatively be arranged to form a rectangular shape about a horizontal plane. The six legs may alternatively be arranged to form a triangular shape about a horizontal plane. The six legs may alternatively be arranged to form a hexagon shape about a horizontal plane.

The structural cell may have nine legs. The nine legs may be arranged beside each other in a common vertical plane. The nine legs may alternatively be arranged to form a square shape about a horizontal plane.

The structural cell may have ten or more legs, the legs arranged in repeating patterns that evenly spread a compressive load placed thereon.

Leg Shape

The legs may be substantially round or elliptical in cross-section and tubular in length.

The tubular legs may be conical. The tubular legs may alternatively be at least in part frustoconical along the leg length.

Alternatively, the legs may be polygonal in cross-section at least in part along the leg length. The polygonal leg cross-section may be triangular, square, pentagonal, hexagonal, octagonal and so on.

The structural cell legs may have a common cross-sectional form along the leg length.

The structural cell legs may have a varying cross-sectional form along the leg length.

Reference within this specification to 'diameter' should not be seen as limiting to purely circular cross-sections. As noted above, the cross-section shape may vary and diameter as a term is used hereafter for prolixity to cover various shapes and forms.

The legs may be widest about the first frame end and narrowest at the terminal end. In one embodiment, the widest leg diameter may be less than 12, or 11, or 10, or 9, or 8 inches and the narrowest leg diameter may be less than 8, or 7, or 6 inches. In one embodiment, the widest diameter may be around 7.5 inches and the narrowest diameter may be around 5.5 inches however the exact dimensions may vary considerably between designs.

The legs may be at least partly hollow. The legs may be at least partially open at: the leg frame end; the leg terminal end; both the leg frame end and the leg terminal end.

The legs may be generally straight although, non-straight e.g. bent legs could also be used. Straight legs may be useful to efficiently transfer a compressive load force along the leg length.

Structural Cell Leg Length

The structural cell legs may have a common length.

The leg length may be fixed, each leg being a continuous integral component.

The structural cell leg length may alternatively be adjustable. Leg length may for example be adjusted using a telescoping assembly. Leg length may alternatively be adjusted by fitting an additional leg section to a first leg section.

The structural cell leg length may be approximately 150, or 175, or 200, or 225, or 250, or 275, or 300, or 325, or 350, or 375, or 400% of the structural cell leg first end diameter. The structural cell leg length may be approximately 5, or 6, or 7, or 8, or 9, or 10, or 11, or 12, or 13, or 14, or 15, or 16, or 17, or 18, or 19, or 20, or 21, or 22, or 23, or 24, or 25, or 26, or 27, or 28, or 29, or 30 inches long. The structural cell leg may for example be 5-30 inches long. In one embodiment, the structural cell leg length may be approximately 5-15, or 8-12, or around 10 inches long. In an alternatively embodiment, the leg length may be approximately 15-25, or 16-23, or 17-21, or around 20 inches long.

Frame and Leg are Integral

The structural cell legs and frame may be one material formed together i.e. integral.

The legs may be moulded with the frame as one element.

Frame Generally and Frame Function

The frame may link the legs together via lateral supports located about the first frame end of each leg. The frame may have a top forming a substantially flat plane that may be generally in a horizontal orientation in anticipated applications but may be angled relative to a horizontal plane if desired (e.g. by up to 1, or 2, or 3, or 4, or 5 degrees), for example to account for substrate angle variations such as uneven ground.

The frame may define the position of each leg relative to each other leg, fixing the leg in position within the overall structural cell volume.

The frame may spread a compressive point load across the structural cell legs. The frame may provide greater rigidity to a structural cell matrix when multiple structural cells are used together. The greater rigidity may prevent the structural cell legs from deforming or moving such as splaying or buckling when under a compressive load.

Frame Lateral Supports

In a generally vertical planar leg configuration, each frame lateral support may meet each leg frame end at approximately 180 degrees to each other lateral support.

In generally square or rectangular leg arrangements, each frame lateral support may meet each leg frame end at right angles to each other lateral support.

In circular or rounded leg frame arrangements, each frame lateral support may meet each leg frame end at approximate right angles—usually within the range of 70-110 degrees to each other lateral support.

Each lateral support may be elongated and narrower in width than first frame end leg diameter size.

Each lateral support may be linear and straight along the elongated length.

Each lateral support may be non-linear and varies in straightness along the elongated length.

Each lateral support may have an arc shape along the elongated length.

Frame and Frame Lateral Support Dimensions

Each lateral support may have a width that is approximately 25, or 30, or 35, or 40, or 45, or 50, or 55, or 60, or 65 or 70, or 75% of the diameter of the first frame end of the leg. The lateral support width may be from 25-75%, or 40-60%, or 45-55% or approximately 50% of the diameter of the first frame end of the leg.

Each lateral support may have a length from leg frame side to leg frame side that is approximately 50, or 55, or 60, or 65, or 70, or 75, or 80, or 85, or 90, or 95, or 100, or 105, or 110, or 115, or 120, or 125, or 130, or 135, or 140, or 145, or 150% that of the diameter of the first frame end of the leg. The lateral support length from leg frame side to leg frame side may be approximately 50-150%, or 75-125%, or 90-110%, or approximately 100% of the diameter of the first frame end of the leg.

In one embodiment of a 3×3 leg square configuration, the frame width may be approximately 30, or 31, or 32, or 33, or 34, or 35, or 36, or 37, or 38, or 39, or 40 inches wide and deep. The frame width and depth may be approximately 30-40 inches, or 32-38 inches, or 35-37 inches, or approximately 36 inches square.

Other square configurations such as a 2×2 leg square configuration may have a smaller proportional size or larger square configurations such as a 4×4 leg square configuration may have a larger proportional size.

Cell Height

The overall cell height from the terminal end of a leg to the top of the planar form defined by the top of the frame such as a frame lip or lips may be approximately 150, or 175, or 200, or 225, or 250, or 275, or 300, or 325, or 350, or 375, or 400% of the cell leg frame end diameter. The cell height may be approximately 5, or 6, or 7, or 8, or 9, or 10, or 11, or 12, or 13, or 14, or 15, or 16, or 17, or 18, or 19, or 20, or 21, or 22, or 23, or 24, or 25, or 26, or 27, or 28, or 29, or 30 inches high. The structural cell height may for example be 5-30 inches high. In one embodiment, the structural cell height may be approximately 5-15, or 8-12, or around 10 inches high. In an alternatively embodiment, the structural cell height may be approximately 15-25, or 16-23, or 17-21, or around 20 inches high.

As may be appreciated from the above frame dimensions and cell height dimensions, the structural cell described herein may be proportionately larger than some art products. Whilst not being limited to the larger sizes noted, a larger structural cell size may be beneficial as this may speed manufacture through fewer units being required, larger more accessible tooling, faster installation on site, and potentially a reduction in the amount of plastic needed for a given matrix volume.

Frame Formwork Detail

The frame lateral supports, leg frame end surrounds and legs may collectively define a common hollow, this hollow defining an internal void space.

The hollow may be bound by an extended lip or lips about the lateral supports and/or leg frame end surrounds.

The common hollow may be the entire volume within all of the lateral supports and leg ends. The common hollow may instead be regions of the lateral supports and/or leg frame ends. The common hollow may be segregated into different regions for example using at least one spar or rib.

The frame end of each leg may open into the legs themselves, the hollow then defined by both the leg opening as well as any hollows defined by the leg frame end and lateral supports.

The hollow or hollows may define a volume configured to receive and retain a structural fluid therein.

The extended lip or lips of the frame may terminate at a common point so as to form a substantially planar finish.

The extended lip or lips may follow the perimeter of all of the frame lateral supports and leg frame endings.

The hollow may open in a direction opposite the direction in which the legs extend orthogonally away from the frame.

Structural Fluid

The structural cell may be configured to receive and retain a structural fluid. The structural fluid may be placed into the structural cell internal void space or hollow as noted above.

The structural fluid may be poured as a liquid or semi-liquid into the common socket or sockets and the structural fluid sets to a solid over time. The structural fluid may only attain structural capabilities once it becomes a solid or 'sets'.

The structural fluid may be concrete.

The structural fluid may be a thermoset polymer.

The structural fluid may give the structural cell its structural capabilities and resistance to compressive load.

The structural fluid may at least partly bear the load of a hardscape placed on the structural cell.

The structural fluid may at least partly bear a load applied by an object on a hardscape placed over the structural cell.

Optionally, the structural cell may be separated from the structural fluid once the fluid has set, the structural fluid taking the same form as the structural cell defining a similar free void space within the set structural fluid shape.

Formwork Cell

In a second aspect, there is provided a structural cell formwork that is configured to receive and retain a structural fluid therein, the structural cell comprising:

- a plurality of hollow legs integrally linked to a frame at a first frame end, the frame linking the legs together and the frame defining a generally flat plane with the legs extending substantially orthogonally away from the first frame end to a leg terminal end; and
- wherein the frame and hollow leg interior collectively define an internal void space that receives and retains a structural fluid placed therein.

As noted above, the internal void space may be at least approximately 1, or 2, or 3, or 4, or 5, or 6, or 7, or 8, or 9, or 10, or 11, or 12, or 13, or 14, or 15, or 16, or 17, or 18, or 19, or 20, or 21, or 22, or 23, or 24, or 25% of the overall structural cell volume. The structural cell internal void space may be approximately 15-25%, or 10-15%, or 5-10%, or 1-5% of the overall structural cell volume.

The internal void space may be substantially located within the hollow legs.

The frame may comprise lateral supports linking the legs together about open leg ends. The lateral supports and leg ends may together define a common hollow that forms the entire internal void space. The common hollow may instead be regions of the lateral supports and/or hollow leg ends. The common hollow may be segregated into different regions for example using at least one spar or rib in the frame lateral supports or legs.

As described elsewhere in this specification, the structural cell may have an additional structural fluid added and the structural cell itself merely acts to retain the structural fluid and does not itself provide any significant structural load capacity to the hardscape, instead only having sufficient strength to receive and retain structural fluid until the structural fluid is set.

A Cell Matrix Using Multiple Structural Cells

In a third aspect, there is provided a load bearing matrix comprising:

- a plurality of structural cells aligned vertically and/or horizontally; and
- a plurality of separate plates, each separate plate being approximately the same width and length as each structural cell, the separate plates located on top of the plurality of structural cells and/or below the plurality of structural cells; and
- wherein each structural cell comprises a plurality of legs integrally linked to a frame at a first leg frame end, the frame defining a generally flat plane with the legs extending substantially orthogonally away from the first leg frame end to a leg terminal end; and
- wherein each separate plate comprises plate sockets linked together via lateral connectors that engage with either an opening in the first leg frame end of a first structural cell, or the leg terminal end of a second structural cell.

The overall matrix volume may be defined by a free void space, an internal void space and a portion of structural cell material itself, wherein:

- the free void space of the matrix is the sum of each structural cell free void space, this structural cell free void space being the space defined by the frame width and depth and the leg height less any space used within this volume for the legs or frame parts and the internal volume defined by the legs and frame; and the internal void space of the matrix is the sum of each structural cell internal void space, this structural cell internal void space being any volume of space within the legs or frame not accessible from the matrix free void space.

The matrix free void space may be at least approximately 75, or 76, or 77, or 78, or 79, or 80, or 81, or 82, or 83, or 84, or 85, or 86, or 87, or 88, or 89, or 90% of the overall matrix volume. The matrix free void space may be approximately 75-85%, or 80-85%, or 85-90% of the overall matrix volume.

The matrix internal void space may be at least approximately 1, or 2, or 3, or 4, or 5, or 6, or 7, or 8, or 9, or 10, or 11, or 12, or 13, or 14, or 15, or 16, or 17, or 18, or 19, or 20, or 21, or 22, or 23, or 24, or 25% of the overall matrix volume. The structural cell internal void space may be approximately 15-25%, or 10-15%, or 5-10%, or 1-5% of the overall matrix volume.

Cell Orientations

The frame may form a horizontal plane structural cell top and the legs extend substantially orthogonally from the structural cell frame in a substantially vertical plane to provide the structural cell height. In a matrix, the structural cells may be aligned vertically with each structural cell frame being located above the legs ('leg down orientation').

Alternatively, the frame may form a horizontal plane cell bottom and the legs extend substantially orthogonally from the cell frame in a vertical plane to provide the structural cell height, the legs terminating at a point above the frame ('leg up orientation'), this termination point being the top of the structural cell. In a matrix, this leg up orientation may be one where the structural cells are aligned vertically with each structural cell frame being located below the legs.

In a further alternative, the structural cells may be aligned in alternate orientation to form a matrix. For example, the structural cells may be aligned vertically with each structural cell frame alternating in orientation from a first layer of structural cells in a frame located below the legs configuration (leg up orientation) to a second layer of structural cells in a frame located above the legs configuration (leg down orientation) and optionally, further alternating layers following the same alternating arrangement.

Optionally, the at least one separate plate may also be fitted intermediate first and second vertically stacked structural cells vertically as well on the base or top of a matrix.

The choice of orientation of cell and matrix may be a combination of factors however, one governing factor may be the load to be taken by the cells and matrix and/or whether a structural fluid is used or not. For example, in low loading scenarios, it may be appropriate to stack the cells in a leg down orientation. In this case, the substrate facing side of the cells (the leg ends) do not spread a load as much as the reverse leg up orientation hence the lower loading scenario. In medium to high load scenarios, it may be appropriate to orientate the cells in a leg up manner so as to present a wide face (the frame side) of the cell to the substrate/ground and therefore provide greater load spreading. In high load scenarios it may be preferable to use an alternating configuration with a leg up base layer and a leg down layer coming next, the ends of the structural cell legs in either cell layer meeting together. Leg down configuration or alternating leg up base layer and leg down next layer configurations may be useful where a structural fluid is used since the structural fluid can be poured into the wider frame end and the structural fluid pours down into the narrower legs and, in the case of an alternating matrix, the structural fluid may pass through leg openings at the leg distal ends and fill out the leg up cell frame region of the lower cell so as to give a larger substrate facing surface. One advantage of the cell shape described herein and the ability to orientate the cells in different ways is the ability of the matrix to deal with less than ideal substrates. Art products may depend on the substrate having been prepared, for example through compaction or through placement of a concrete surface, so that the art cell is applied to an already hard and level surface. This may be to address point load problems where an unprepared surface may lead to unwanted sagging or movement of the cell matrix about weaker or uneven regions. The cells described herein may, for example through leg up orientation do not require special substrate preparation since the frame of the cell has sufficient load spreading capability to avoid or minimise point loading.

Separate Plate General Structure and Function

The separate plate may be substantially planar comprising plate sockets and plate lateral supports linking the plate sockets together in a desired configuration.

The separate plate may be used to impart rigidity to a structural cell, for example retaining the leg terminal ends in a desired configuration even when under compressive loading. As described further below, the separate plate may comprise linkages that may be used to link to other separate plates and the thereby help confer greater rigidity and strength to a matrix of structural cells.

Plate Socket and Plate Lateral Support Configuration

The position of the plate sockets and plate lateral supports may substantially mirror the configuration of the frame lateral supports and frame ends of the legs.

Specifically:

in a generally vertical planar leg configuration, each plate lateral support may meet each plate socket at 180 degrees to each other plate lateral support;

in a generally square or rectangular arrangement, each plate lateral support may meet each leg end (frame or terminal leg end) at right angles to each other plate lateral support;

each plate lateral support may be elongated and narrower in width than the plate socket diameter;

each plate lateral support may have a width and/or depth that is approximately 25, or 30, or 35, or 40, or 45, or 50, or 55, or 60, or 65 or 70, or 75% of the diameter of the plate socket;

each plate lateral support may have a length from plate socket to plate socket that is approximately 50, or 55, or 60, or 65, or 70, or 75, or 80, or 85, or 90, or 95, or 100, or 105, or 110, or 115, or 120, or 125, or 130, or 135, or 140, or 145, or 150% that of the diameter of the plate socket.

Plate Lateral Supports

The plate lateral supports may be ribbed elongated members.

The plate lateral supports may have a U-shaped or H-shaped cross section.

Each plate lateral support may be linear and straight along the support elongated length.

Alternatively, each plate lateral support may be non-linear and vary in path along the support elongated length.

Each plate lateral support may have an arc shape along the support elongated length.

Plate Socket Shape

The plate sockets may have a cross-sectional shape that substantially complements and snugly fits the shape of the terminal end of each leg and/or the shape of the frame end of each leg. Reference is made above to a socket diameter implying a circular socket shape. As should be appreciated, the plate socket shape may vary from circular and reference to the term 'diameter' should not be seen as limiting.

The sockets may be collar shaped with a substantially circular cross-section.

The socket collar height may be approximately 10, or 15, or 20, or 25, or 30, or 35, or 40, or 45, or 50, or 55, or 60, or 65, or 70, or 75% that of the leg terminal end diameter. The socket collar height may be approximately 10-75%, or 20-75%, or 40-60%, or approximately 50% that of the leg terminal end diameter.

The socket collar height may be approximately 10, or 15, or 20, or 25, or 30, or 35, or 40, or 45, or 50, or 55, or 60, or 65, or 70, or 75% that of the leg frame end diameter. The socket collar height may be approximately 10-75%, 20-75%, or 40-60%, or approximately 50% that of the leg frame end diameter.

In one embodiment, the socket collar height may be approximately 2, or 2.5, or 3, or 3.5, or 4, or 4.5, or 5, or 5.5, or 6 inches tall. In one embodiment the height may be approximately 2-6, or 3-5, or around 4 inches tall.

The socket collar height may be approximately the same irrespective of use or otherwise of the plate at the leg terminal ends or frame ends.

The plate sockets may have an open configuration so that, if a structural fluid is used, the structural fluid may pass through the plate sockets.

Plate Socket Fitting

Each plate socket may, if fitted to the frame, fit as a snug male fitting partly into the top female side of an opening in the leg frame end of a first structural cell. The opposing leg terminal end of a second structural cell may fit as a male fitting into the opening (female side) of the plate socket. Reverse male/female configurations to the above may also be used.

The socket collar may have frustroconical interior walls that allow the leg terminal end and/or leg frame end to mate snugly with the socket collar interior or exterior walls depending on the male/female orientation used.

Each socket collar may be formed in two halves for example comprising:

- a first female half with frustroconical interior walls cambered so as to move from a wider opening diameter to a narrower mid-diameter and;
- a second male half with frustroconical exterior walls cambered so as to move from a narrower opening diameter to a wider mid-diameter.

The socket collar exterior or interior may include friction modifying features to increase the retention such as keying or roughened surfaces or features to decrease the retention such as smoothed surfaces or material choices.

Plate Lateral Connectors

The, or each, separate plate may optionally have at least one lateral connector used to link multiple plates across a common (e.g. horizontal) plane. When used with the structural cell described above, the separate plates may be used to provide a cell matrix with horizontal plane stability acting to align the cells. These lateral connectors may be used in practice to connect abutting structural cells together. The connection may be about a substantially horizontal plane with no or minimal separation distance between the structural cells in the matrix other than the distance defined by the lateral connectors shape and form. The lateral connectors may, in one embodiment, have a shape and form that enables the legs of each structural cell in a matrix to be substantially equidistant to each other.

The at least one lateral connector may extend from the separate plate laterally about a plane defined by the separate plate planar face.

Each separate plate may comprise a plurality of lateral connectors.

The separate plate lateral connectors may be integrally formed with other separate plate parts such as the plate lateral supports and/or plate sockets. The separate plate lateral connectors may not be separate parts.

Each separate plate may have at least one lateral connector extending outwardly from a plate perimeter.

The at least one lateral connector may extend outwardly in an orthogonal direction from a plate lateral support.

A single lateral connector may extend from each plate lateral support between plate sockets.

Each lateral connector may extend outwardly from a plate lateral support approximately 25, or 30, or 35, or 40, or 45, or 50, or 55, or 60, or 65, or 70, or 75% the diameter of a plate socket.

Each lateral connector may terminate about the widest point of each plate socket so that the lateral connector ending is approximately level with a separate plate edge defined by the maximum socket outer face position.

Each lateral connector may terminate with either a T-shaped member or a C-shaped member, the T-shape and C-shape substantially complementing each other so as to join together.

In one embodiment, the separate frame may comprise a 3×3 socket square shape and each outward facing plate lateral support comprises a lateral connector extending therefrom. In this embodiment, the terminal end of each lateral connector may alternate between a T-shaped ending and a C-shaped ending on a first separate plate so as to complement alternating T-shaped or C-shaped endings of a further separate plate located alongside the first separate plate.

Cell Lateral Connectors

As an alternative to the above (or in combination with the above), a cell or cells may have lateral connectors extending from the cell side(s) to allow connection between abutting cells, typically about a horizontal plane. The cell lateral connectors may extend for example from the leg frame end.

The cell lateral connection may as noted above be about a substantially horizontal plane with no or minimal separation distance between the structural cells in the matrix other than the distance defined by the cell lateral connector shape and form. The cell lateral connectors may, in one embodiment, have a shape and form that enables the legs of each structural cell in a matrix to be substantially equidistant to each other.

The at least one lateral connector may extend from the cell frame laterally about a plane defined by the upper planar surface of the frame.

Each cell may comprise a plurality of cell lateral connectors.

The cell lateral connectors may be integrally formed with the cell and may extend the line generally defined by the connectors used to link the legs of the frame. The cell lateral connectors may not be separate parts.

Each cell may have at least one lateral connector extending outwardly from a cell frame perimeter.

The at least one cell lateral connector may extend outwardly in an orthogonal direction from a cell frame.

Each cell lateral connector may extend outwardly from a cell frame approximately 25, or 30, or 35, or 40, or 45, or 50, or 55, or 60, or 65, or 70, or 75% the diameter of a plate socket.

Each cell lateral connector may terminate with either a T-shaped member or a C-shaped member, the T-shape and C-shape substantially complementing each other so as to join together.

In one embodiment, the cell frame may comprise a 3×3 socket square shape and each outward portion of the frame comprises a cell lateral connector extending therefrom. In this embodiment, the terminal end of each cell lateral connector may alternate between a T-shaped ending and a C-shaped ending so as to complement alternating T-shaped or C-shaped endings of a further cell located alongside the first cell.

Free Sockets

Optionally, separate free sockets may be used alone with no separate plate or plate lateral supports linking the free sockets.

In this embodiment, the free socket or free sockets may be used between cells vertically so as to locate structural cells together. The free sockets may also provide a common spacing between structural cells.

The free sockets may align multiple structural cells vertically and prevent movement of a structural cell matrix.

The free sockets may be separate parts mated to the structural cells as required.

The matrix may further comprise at least one free socket placed intermediate vertical spaced structural cells, each free socket linking together an opening in the frame end of a leg in a first structural cell with the terminal end of a leg in a second structural cell.

Like for the separate plate, each free socket may fit as a snug male fitting partly into the top female side of an opening in the frame end of a leg in a first cell. The opposing terminal end of a leg in a second cell may fit as a male fitting into the opening (female side) of the socket. The reverse male/female configuration may also be possible.

The dimensions, form and function of the free socket may be largely identical to the plate socket and further details on this are provided above and not repeated here.

The free sockets may, when placed inside the frame end of a leg, act to provide a footing or stop inside a leg opening that the exterior of a terminal end of a next cell leg abuts and is supported on.

The free sockets may have an open configuration so that, if a structural fluid is used, the structural fluid may pass through the free sockets.

Materials

The materials used to produce the structural cell above, the separate plate(s), and the free sockets may be selected from: plastics, composites, metals, metal alloys, and combinations thereof.

Plastics if used may optionally be reinforced. For example, the plastics may be reinforced using fibres such as glass fibres.

Plastics if used may be at least in part recycled plastic.

The structural cells, separate plates and free sockets may be moulded items.

Kits, Transport, Storage, Assembly

The structural cells, separate plates and free sockets may form a kit of parts with or without a set of instructions. The kit of parts may be stored and transported in a disassembled form and assembled in situ.

In transport or storage, the structural cells may nest together, the legs of one structural cell nesting into frame openings of the legs in a subsequent structural cell.

In transport or storage the separate plates may be stacked on top of each other.

The parts may be light weight and easy to transport and move. For example, each structural cell may be approximately 1, or 1.5, or 2, or 2.5, or 3, or 3.5, or 4, or 4.5, or 5, or 5.5, or 6, or 6.5, or 7, or 7.5, or 8, or 8.5, or 9, or 9.5, or 10 kg each. In one embodiment, each structural cell may weigh approximately 2 to 8 kg. In a further embodiment, each structural cell may weigh approximately 3 to 5 kg. If concrete is poured into the structural cells as described further below, the structural fluid taking up the load imposed on the cell, the amount of structural cell material may be reduced, potentially to only that needed to retain the structural fluid in place prior to hardening. As a result, the basic structural cell weight could be further reduced if desired.

The different parts may be assembled toolessly. That is, the parts do not require the use of separate fasteners, hand tools such as hammers or screw drivers or power tools such as cordless drills in order to be assembled. Assembly uses a minimum of parts and can be completed with minimal training and experience.

In one embodiment, each structural cell in the matrix may approximately abut the other structural cell about a horizontal plane with no or minimal separation distance between the structural cells in the matrix. Each structural cell in the matrix may approximately abut the other structural cell about a horizontal plane so that the legs of each structural cell may be substantially equidistant to each other. Equidistant spacing may be achieved through use of extensions or widened frame construction or the lateral connectors noted above so as to still allow structural cell abutment but also impose a distance of separation between the structural cell legs. Separate linking members could also be used and reference to integral connectors or the lateral connectors noted earlier in this specification should not be seen as limiting.

Optionally, the matrix may further comprise at least one free socket placed intermediate vertical spaced structural cells, each free socket linking together an opening in the frame end of a leg in a first structural cell with the terminal end of a leg in a second structural cell.

Concrete Cell

In a fourth aspect, there is provided a structural cell formed from hardened structural fluid, the structural cell comprising:

a plurality of solid legs linked to a frame at a first frame end, the frame defining a generally flat plane with the legs extending substantially orthogonally away from the first frame end to a leg terminal end; and wherein the structural cell defines a free void space therein, the free void space defined by the frame width and depth and the leg height, less any space used within this volume for the legs or frame parts.

Concrete Cell Matrix

In a fifth aspect, there is provided a load bearing matrix comprising:

a plurality of structural cells stacked vertically and/or horizontally wherein each structural cell is formed as one element from hardened structural fluid, each structural cell comprising:

a plurality of solid legs linked to a frame at a first frame end, the frame defining a generally flat plane with the legs extending substantially orthogonally away from the first frame end to a leg terminal end; and wherein the structural cell defines a free void space therein, the free void space defined by the frame width and depth and the leg height, less any space used within this volume for the legs or frame parts.

In the above structural fluid cell and matrix, the structural fluid used to form the structural cell may be poured into a structural cell formwork and the formwork remains with the structural cell. The formwork may instead be removed once the structural fluid hardens.

The structural fluid in the above cell and matrix may be concrete.

The structural fluid in the above cell and matrix may be a thermoset polymer.

The structural fluid in the above cell and matrix may give the structural cell/matrix its structural capabilities and resistance to compressive load.

Pouring of the structural fluid may occur in situ at or about the final structural cell or matrix position.

The structural cell and/or matrix described in the aspects above may have a compressive strength in excess of 300, or 400, or 500, or 600 kPa. The structural cell and/or matrix described in the above aspects may have substantially no elastic deformation/deflection prior to the compressive strength being reached.

Blanks

A cell or matrix may be fitted with a blank or blanks. In one embodiment, a blank may be configured to cover part or all of the hollow in the cell frame and legs, the hollow being a fluid holding portion e.g. internal void space, of the cell. Alternatively, a blank may be configured to cover part or all of the openings leading to the free void space inside the cell or matrix and block access to the internal void space. In a further embodiment, a blank may be configured to block access from the top of the cell into either the free or internal void scape of the cell or matrix.

The blank or blanks may be used for example to segregate the different void spaces for example to allow the structural fluid to enter the internal void space but be excluded from the free void space. Alternatively, the blank prevents substrate such as water or soil entering the internal void space and only allows access to the free void space. The blank may also be used to support foot traffic on the cell or matrix and other items such as bar chairs for concrete placement.

Side Panels

As noted above, the cell(s) may be inserted into a pit or built above ground. Side panels may be erected around the cell/matrix to provide a solid wall or walls around the cell/matrix and hence provide a boundary for where substrate such as soil or water may extend to from the free void space inside the cell or matrix.

Base Panel or Footing

Optionally, a cell or matrix of cells may comprise a base panel or similar footing or footings that are placed on a substrate and on which the cell/cells are placed thereon. The base panel or footing(s) may have sufficient structural properties to prevent movement of the cell(s) or part thereof, particularly the cell(s) legs, when a compression load is placed on the cell(s). The base panel or footing may also have sufficient structural properties to prevent localised displacement of a part or all of a cell or cells into the substrate or ground on which the cell(s) are placed. The structural properties noted may be strength to support a compressive load and rigidity to prevent or minimise relative displacement about the base panel or footing area.

Cell or Matrix Options

The above described structural cell or matrices may have service lines running through at least one structural cell or at least part of the matrix free void space.

Optionally, the at least one structural cell or at least part of the matrix may have a permeable or non-permeable wrap or barrier beneath, around or above the structural cell/matrix. This may be a geotextile, plastic wrap or other layer to separate the structural cell or matrix from the surrounding environment.

Optionally, the at least one structural cell or at least part of the matrix free void space may be at least partly back filled with a substrate. The substrate may be selected from: soil or plant rooting media; filtration media; aggregate; and combinations thereof.

The soil if used may act as a growing medium for rooting plants. The soil may be uncompacted. The soil may be partly compacted.

Optionally, the at least one structural cell or at least part of the matrix may bear a load thereon. The load may be a static or dynamic load. The load may be a hardscape. The hardscape may be a road or pavement. The hardscape may have a load placed thereon such as people, vehicles, machinery and so forth.

Optionally, the at least one structural cell or at least part of the matrix free void space may be left open and clear of any other materials.

Optionally, the matrix may allow ingress of water into at least part of the matrix free void space. Egress of water from the structural cell/matrix free void space or a part thereof may also be prevented or slowed. Ingress and prevention of egress may be a way to catch and store storm water run off for alternative uses such as irrigation. This application and others are described in more detail below.

The legs of one structural cell in a matrix may substantially align with the legs of a second and subsequent vertically stacked structural cell so as to provide a common transfer of compressive load down a single leg column from the top of a matrix to the bottom of the matrix. That is, there is a continuous alignment of the legs and transfer of compressive load across successive structural cells.

Openings in the free void space of the matrix may be substantially continuous from top to bottom or side to side of the matrix. That is, the openings in the free void space of one structural cell may substantially align with the openings in any additional structural cells used.

A cell matrix described may also comprise at least one aeration line. The aeration line may extend vertically through the matrix spanning some or all of the structural cells therein.

Method

In a sixth aspect, there is provided a method of forming a load bearing matrix, the method comprising the steps of:

- select at least one structural cell substantially as described above and a substrate on which the load bearing matrix will be formed;
- place separate plates on the substrate;
- place a first layer of structural cells on the separate plates;
- repeat placing of structural cell layers vertically until the desired matrix height is reached;
- place separate plates on top of the final structural cell layer; and optionally,
- placing a load on the matrix.

Optionally, the linking the cells and/or separate plates may be linked together via at least one lateral connector during the method above.

Optionally, barrier material may be positioned in the pit base or sides before the first separate plate layer is placed onto the pit substrate.

Optionally, after fitting the first or other subsequent layer of structural cells in the matrix, free sockets and/or separate plates may be fitted to the lower layer of structural cells before placement of a further layer of structural cells thereon.

Optionally, where a structural fluid is used, the structural fluid may be poured into the at least one structural cell during matrix assembly.

Applications

The cells and cell matrices described above may be used in a variety of ways both like traditional structural cells, as well as in new applications, such as those where leg or other part deflection was an issue or limiting factor.

One example typical application may be to fill the cell void space with uncompacted soil so as to allow for tree root growth within the cell under a hardscape such as a road or pavement. The cells and matrices described may perform this function with or without concrete infill and thereby act in this traditional manner. An advantage though of the cell design described over the art is that the material requirements of the design described are, in the inventor's experience, lower than art designs meaning a lower overall cell cost.

An alternative application may be to use the cell void space as a water reservoir where the void space is used to capture and retain, or at least partly retain, storm water. Retention of water (or other liquids) may be indefinite or, alternatively for a pre-determined period of time. Retention may be to provide a buffer, for example in stormwater drains, thereby reducing the impact of flash flood events on stormwater treatment systems by limiting the flow of water to a stormwater system. The limited flow may be pre-set to a volume that the system can cope with and thereby avoiding flooding, unwanted outfall or other undesirable events. Full retention may be used to store water for a future time when water is needed e.g. for irrigation. Liquid egress from the structural cell or matrix may be through the cell or matrix base or walls or even through an orifice. Retention may be achieved using impermeable layers around the outside of a structural cell volume or the outside of a matrix. The impermeable layer may have areas that are open e.g. to an orifice or through a filter so as to direct egress of liquid from the matrix.

The cells or matrices may also be used as filters. For example, stormwater run off may enter cells/matrices and the cells/matrices may contain filtration media. The stormwater in this example may pass through the filter material and be purified or screened prior to release into the ground or to a transport system post filtration. The same principle could be used for bunding for example around petrochemical storage tanks (or used in the ground surrounding petrochemical storage tanks) as a means to capture and even treat a spill.

There can also be other uses for structural cells or matrices using the structural cells where void space is needed in order to fill a volume and where some degree of structural strength and integrity is required. One example might be in the construction of roadside berms, over bridges and the like where structural cell matrices may provide an alternative to transporting and delivery of significant volumes of infill. Another example may be in the construction of bunding around tanks, hill screening for privacy and security and so on.

Another cell/matrix volume fill application may be about firewalls or partitions between building levels. Optionally the cell void space could be filled with flame retardant, service lines and so on.

A yet further application may be to provide a spacing between a building roof top and garden on the roof top, the cells and matrix formed from the cells providing both a structural level that can be walked on as well as at least in part, a growing medium for trees or other larger rootball plants.

A yet further application of the cells and matrix described may be to replace and/or supplement other load bearing materials in building foundations. In recent times, at least in earthquake prone areas, domestic house foundations are constructed using so-called 'rib raft' or 'raft' foundations that have load bearing members amongst polystyrene or other high volume materials as a filler. The cells and matrices described herein may perform a similar function to the load bearing members and polystyrene fillers all from one matrix and, for example, only filling selected cells with concrete.

Advantages of the above cell and matrix are described above, however one advantage reiterated here may include elimination of any deflection of the legs or other parts when subjected to a compressive load. Deflection using art products may be small but this still may be of some importance when used beneath pavements subjected to unrestricted or dynamic vertical loads. If a brittle hardscape or higher load is used, deflection to any extent may be detrimental to the hardscape or surrounding material. The structural cell described, particularly when filled with a structural fluid that hardens, may better withstand compressive loads and completely avoid any deflection at all. Concrete in particular represents a useful structural fluid since it is well understood and widely used and accepted in structural applications. The cells and matrices described may further allow for new applications and uses of structural cells thereby increasing the design versatility and usage.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as of individually set forth.

WORKING EXAMPLES

The above described structural cells, matrices and methods of assembly are now described by reference to specific examples.

Example 1

FIGS. 1-14 illustrate various embodiments of one form of structural cell and matrix.

Figure 2:
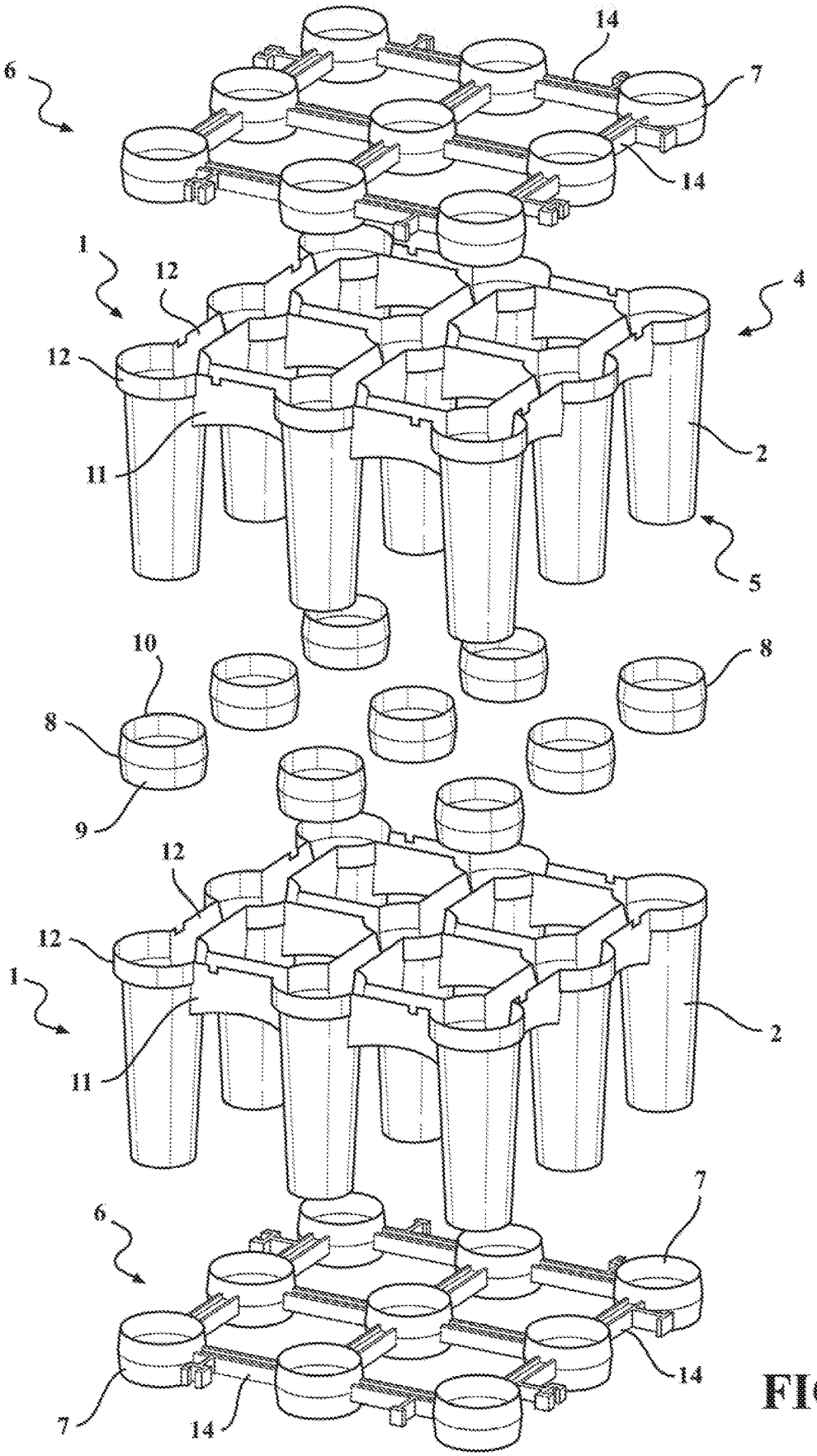
FIG. 2 illustrates an exploded perspective view of an alternative configuration of a structural cell matrix.

As shown in at least FIG. 1 and FIG. 2 a structural cell generally indicated by arrow 1 may be a combination of a plurality of legs 2 integrally linked to a frame 3 at a first frame end 4, the frame 3 linking the legs 2 together and defining a generally flat plane with the legs 2 extending substantially orthogonally away from the frame 3 plane to a leg 2 terminal end 5. The structural cell 1 may also comprise a separate plate 6 engaging the legs 2, the separate plate 6 comprising sockets 7 linking via plate lateral supports 14, each socket 7 engaging the leg 2 terminal ends 5. Alternatively, the sockets 7 engage the leg 2 frame 3 ends 4.

Figure 6:
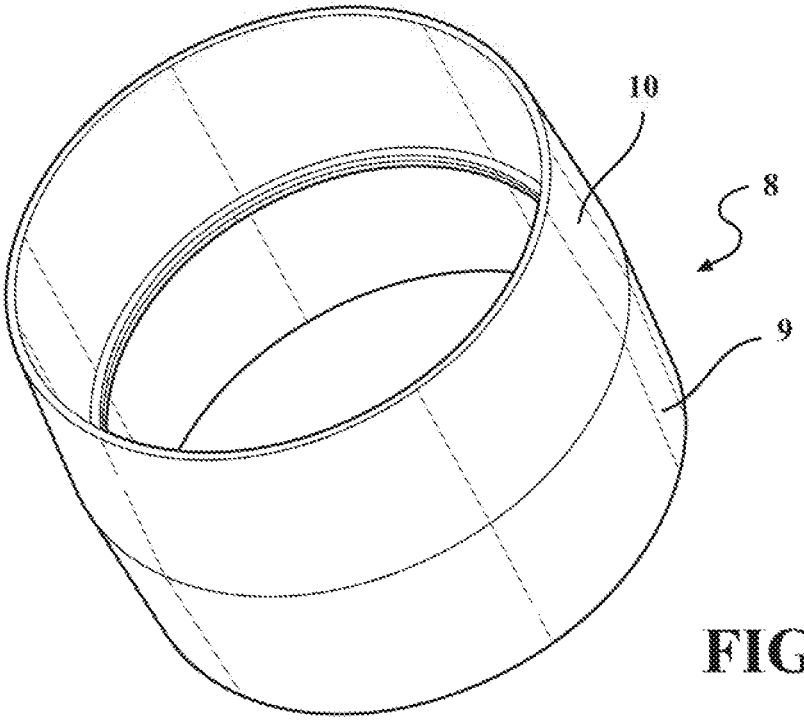
FIG. 6 illustrates a perspective view of a free collar.

FIG. 1 illustrates one matrix arrangement starting with a separate plate 6 as a base, a cell 1 with legs 2 and a frame 3, then another separate plate 6, then a subsequent cell 1 with legs 2 and a frame 3, then topped with a further separate plate 6. FIG. 2 illustrates an alternative arrangement where the separate plate 6 is used again on the base and top of the matrix however, intermediate the cells lie free sockets 8, one socket 8 for each leg 2 frame end 4. Note that a specific view of the free socket 8 is shown in FIG. 6. The bottom side 9 of each free socket 8 engages the top of a leg 2 at the frame 3 end 4 of a leg 2. Engagement is by a male/female fitting, the free socket 8 lower end fitting as a male fitting into the female opening of the leg 2. The upper cell terminal leg 2 ends 5 fit again via a male/female connection, in this case, the leg 2 terminal ends 5 fit as male fittings into the top side 10 of the free socket 8.

Figure 3:
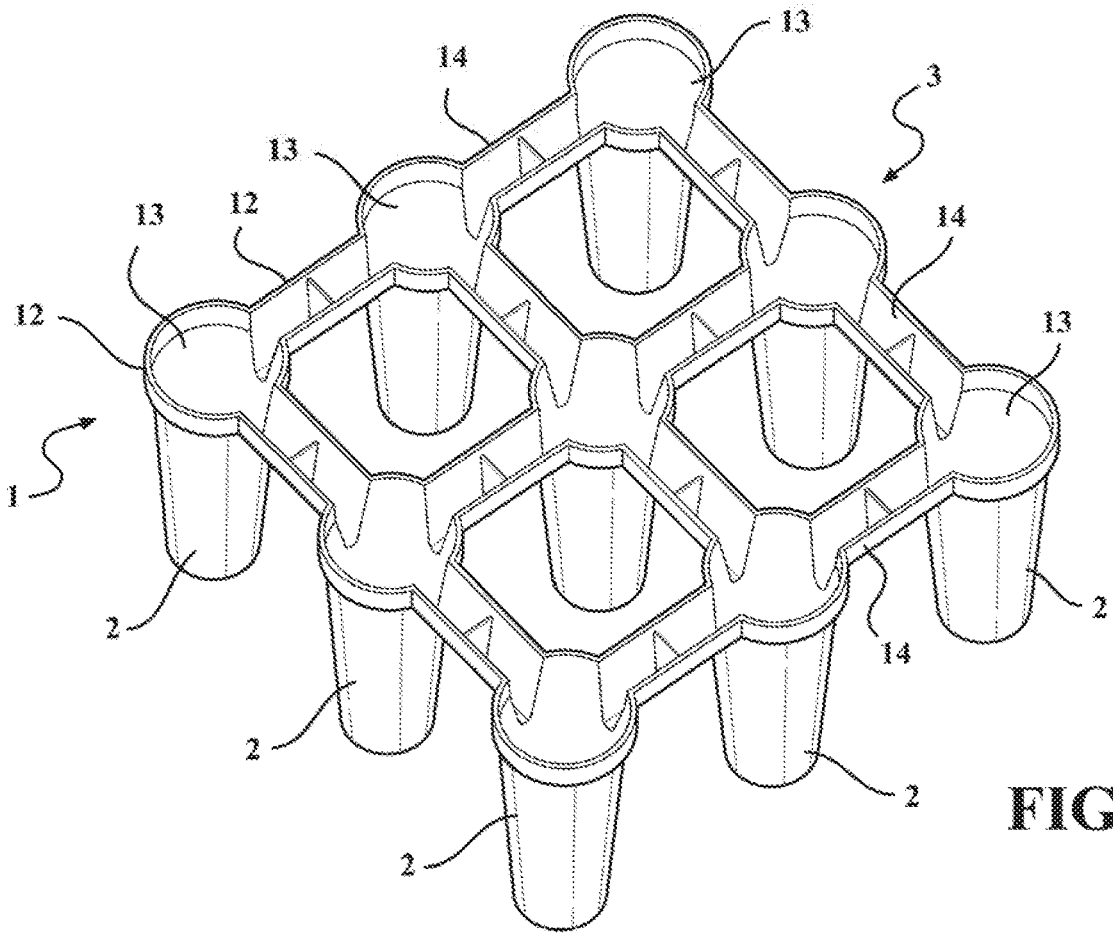
FIG. 3 illustrates an embodiment of a perspective view from above of a 3×3 leg configuration frame and legs.
Figure 4:
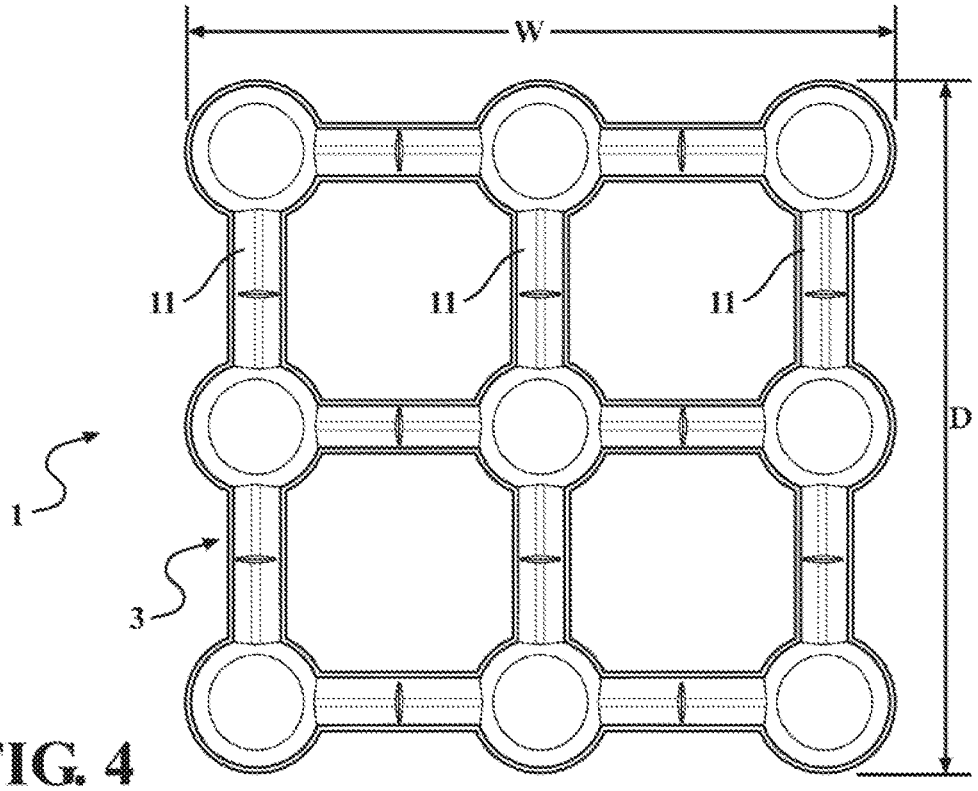
FIG. 4 illustrates the 3×3 frame and leg arrangement above in a plan view.
Figure 5:
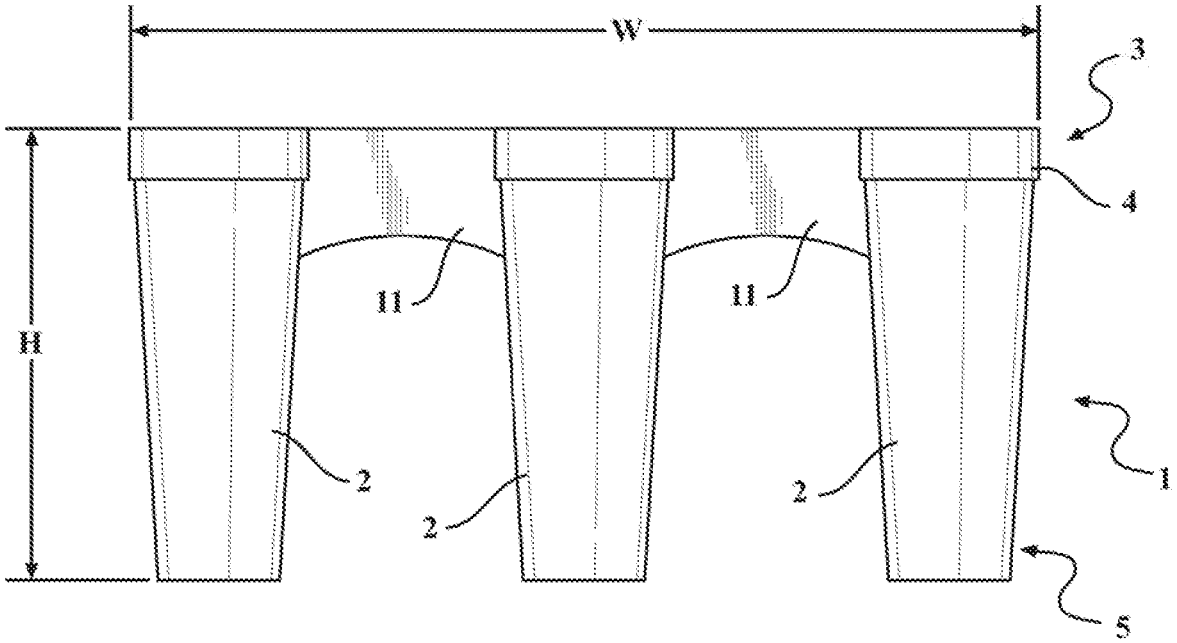
FIG. 5 illustrates the 3×3 frame and leg arrangement above in a side view.

The overall structural cell 1 shape best seen in FIG. 3, FIG. 4 and FIG. 5 is defined by the extent of the frame 3 width, depth and the leg 2 length. As shown in the Figures, there are no other items or parts present about the structural cell 1 height other than the legs 2. When viewed side on such as the views shown in FIGS. 5, 9 and 14, each structural cell may present openings completely through the structural cell or matrix between the legs 2.

The overall structural cell 1 volume is defined by a free void space e.g. that between the cell 1 legs 2, an internal void space such as the open space inside the legs 2 and frame 3 and a portion of structural cell 1 material itself. The free void space is the space defined by the frame 3 width W and depth D and the leg 2 height H shown in FIG. 3, FIG. 4 and FIG. 5 less any space used within this volume for the legs 2 or frame 3 parts and any internal void space within the legs 2 and frame 3. The internal void space may be defined by any volume of space within the legs 2 or frame 3 not accessible from within the free void space. As should be appreciated, none of the leg 2 volume may be accessible from the free void space if the legs 2 are continuous in form along their height H for example being solid legs (not shown) or alternatively being hollow legs 2 as shown in the Figures but without any openings accessible from inside the free void space. Alternatively, at least some of the leg 2 volume may be accessible to the free void space if the leg 2 or legs 2 are hollow internally and if an opening exists in the leg sides (not shown).

The hardscape (not shown) may be a road or pavement laid over the top of a matrix, typically over the top of an uppermost separate plate 6.

The structural cell may have multiple legs 2, the legs 2 arranged relative to each other in regular or even patterns that collectively spread a compressive load placed thereon. The Figures illustrate cells 1 with a total of nine legs 2 arranged in a 3×3 grid or square shape. This should not be seen as limiting since a variety of other leg 2 numbers and configurations may also be used.

The legs 2 shown in the Figures are substantially round in cross-section and tubular in length having a frustroconical shape. The legs 2 may take other shapes and forms not shown. The tubular legs 2 are widest about the frame 3 end 4 and narrowest at the terminal end 5.

The legs 2 shown in the Figures are hollow and open at the frame 3 end 4 with the terminal end 5 being closed. This may be a useful configuration when structural fluid hereafter referred to as being concrete is poured into the cells 1.

The legs 2 have a common length or height H. The leg 2 height H may vary, in the embodiments illustrated being approximately 16-20 inches long although this dimension may be varied depending on the desired design and end applications.

The structural cell 1 legs 2 and frame 3 as shown in the Figures are one material formed together i.e. integral.

The frame 3 comprises lateral supports 11 linking the frame 3 end 4 of each leg 2, the frame 3 as a whole defining a generally flat plane. In the Figures, the frame 3 flat plane is in a horizontal orientation but this orientation may be angled (not shown) relative to a horizontal plane if desired (e.g. by up to 1, or 2, or 3, or 4, or 5 degrees), for example to account for substrate angle variations such as uneven ground.

The frame 3 and lateral support 11 positioning defines the position of each leg 2 relative to each other leg 2, fixing the leg 2 in position within the overall structural cell 1 volume.

In the square leg arrangement shown in the Figures, each frame 3 lateral support 11 meets each leg 2 frame 3 end 4 at approximately right angles (90 degrees) to each other lateral support 11.

Each lateral support 11 is elongated and narrower in width than frame 3 end 4 leg 2 diameter size. Each lateral support 11 is linear and straight along the elongated length.

Each lateral support 11 has a width that is approximately 50% of the diameter of the first frame 3 end 4 of the leg 2 however this width may be varied.

Each lateral support 11 has a length from leg 2 frame 3 side to leg 2 frame 3 side that is approximately 100% of the diameter of the frame 3 end 4 of the leg 2.

In the 3×3 leg 2 square configuration shown in the Figures, the frame 3 width and depth may be approximately 35-37 inches, or approximately 36 inches square.

The overall cell 1 height H from the terminal end of a leg 2 to the top of the planar form defined by the top of the frame 3 such as a frame lip or lips 12 may be approximately 150 to 400% of the cell 1 leg 2 frame 3 end 4 diameter. In the Figures, the overall cell 1 height is around 16-19 inches or approximately 18 inches high.

The frame 3 lateral supports 11 and leg 2 frame 3 end 4 surrounds may collectively define a common hollow generally shown by arrow 13 in FIG. 3, this hollow 13 being equivalent to the internal void space noted above. The hollow 13 is bound in the Figures by an extended lip or lips 12 about the lateral supports 11 and/or leg 2 frame 3 end 4 surrounds.

The common hollow 13 as shown in the Figures is the entire volume within all of the lateral supports 11 and leg 2 ends 4. The hollow 13 or hollows 13 define a volume that is capable of receiving and retaining concrete (not shown) therein.

The extended lip or lips 12 of the frame 3 may end at a common point so as to form the frame 3 substantially planar finish. The extended lip or lips 12 follow the perimeter of all of the frame 3 lateral supports 11 and leg 2 frame 3 endings 4.

The concrete (not shown) may be poured as a liquid or semi-liquid into the hollow or hollows 13 optionally through the plate sockets 7 or free sockets 8 if used and the concrete sets to a solid over time.

As shown in FIGS. 1 and 2, the cells 1 may be orientated to have the cell 1 frame 3 at the top with the legs 2 extending below the frame 3. Multiple structural cells 1 are stacked vertically using this same orientation with each structural cell frame 3 being located above the legs 2.

Alternatively (not shown), the frame 3 may form the cell base and the legs extend substantially upwardly from the cell 1 frame 3. Multiple structural cells 1 may be stacked using this same orientation with each structural cell 1 frame 3 being located beneath the legs 2.

Figure 9A:
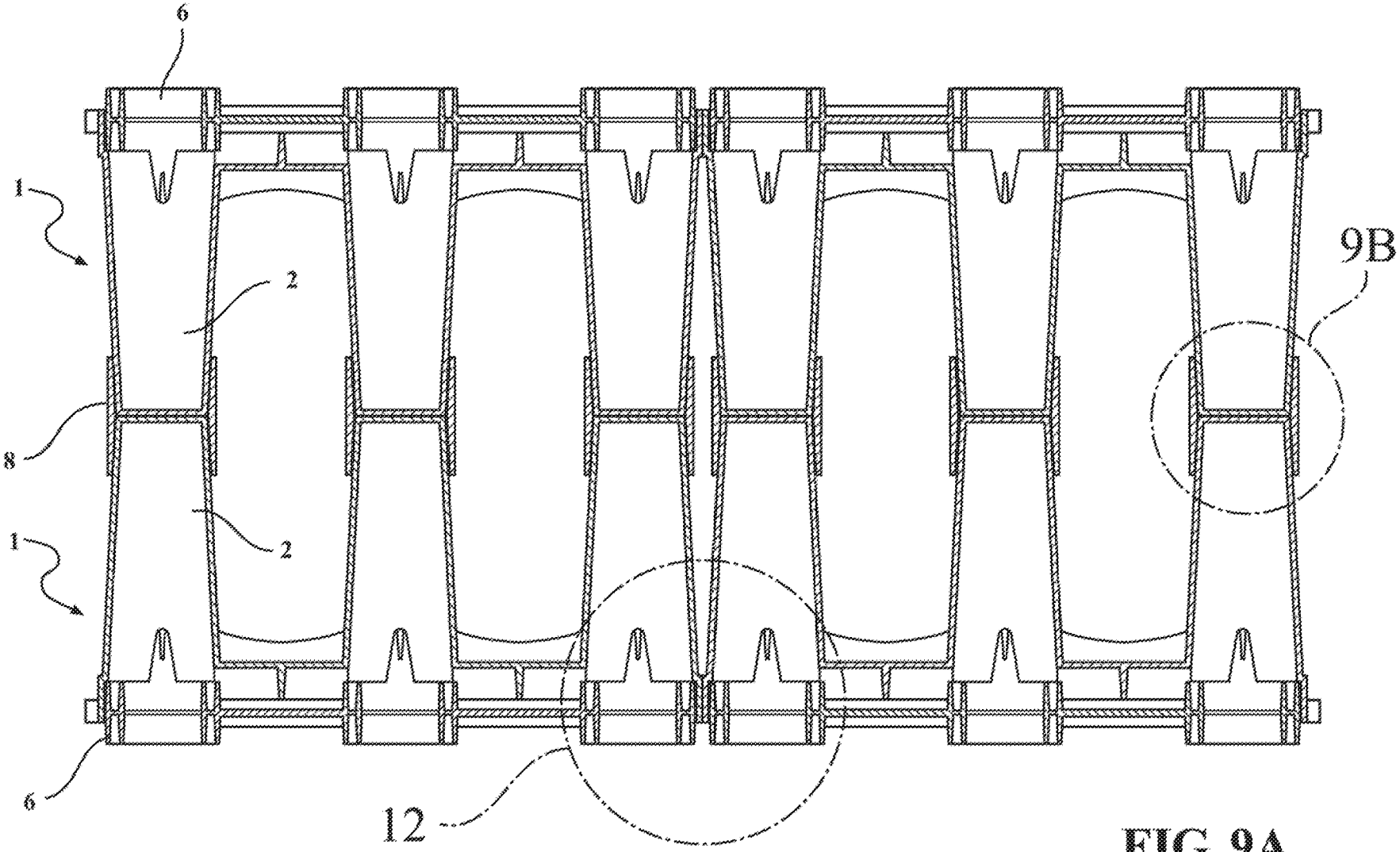
FIG. 9A illustrates a side view of the matrix above and a detail view 9B.
Figure 9B:
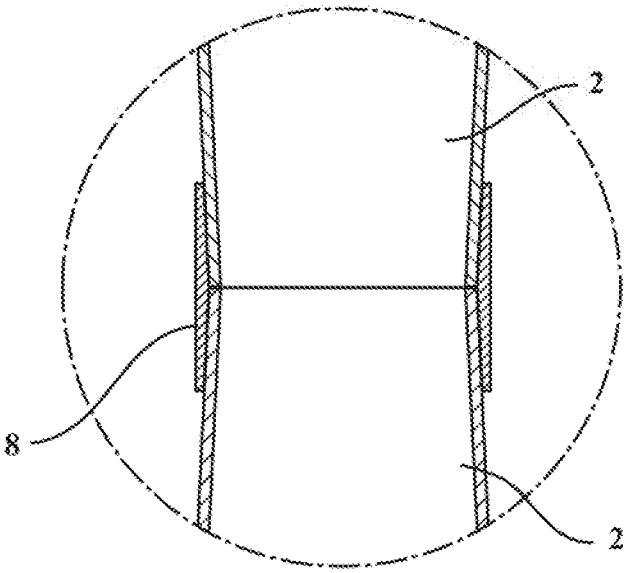
Figure 10:
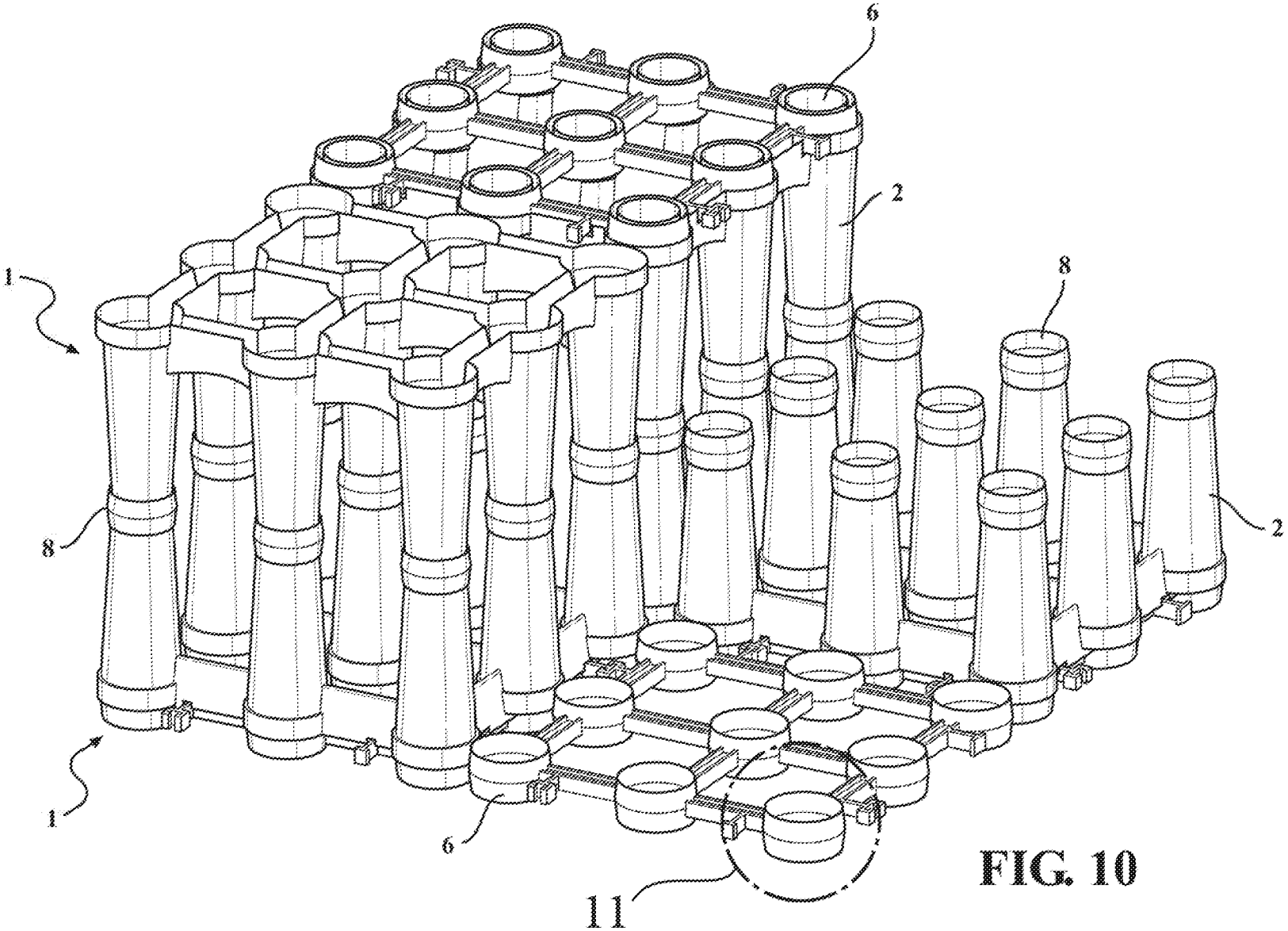
FIG. 10 illustrates a perspective view from above of a part assembled matrix.
Figure 14B:
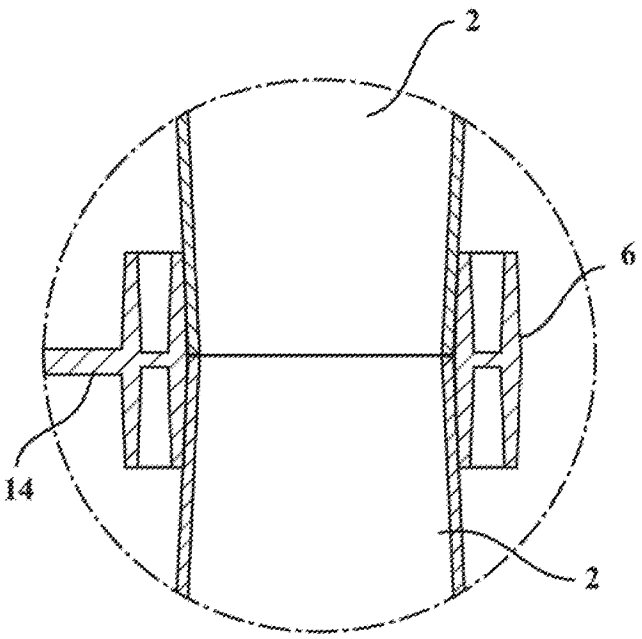
FIG. 14A illustrates a side view of the alternative part assembled matrix of FIG. 13 and detail 14B.
Figure 12:
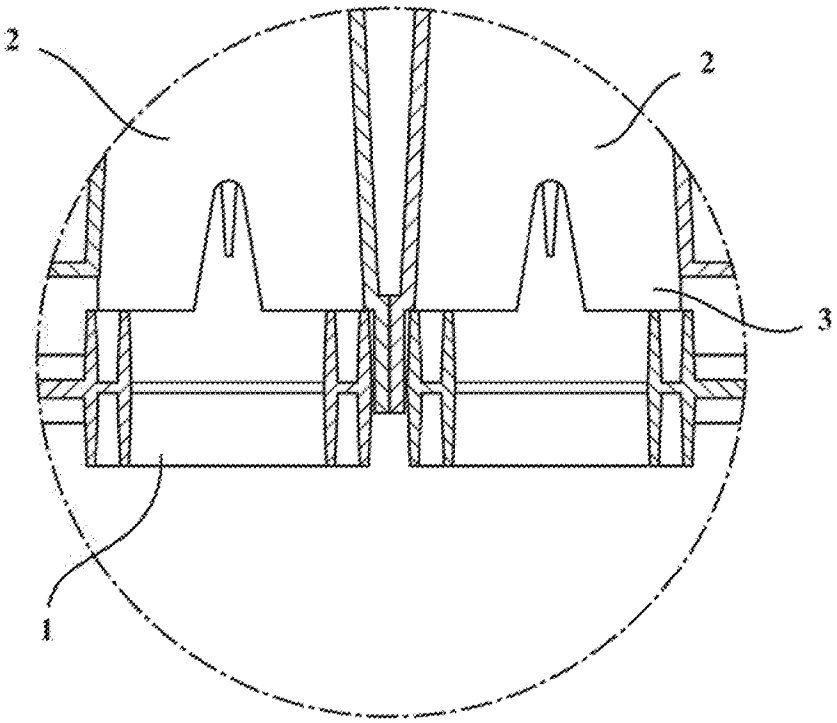
FIG. 12 illustrates detail 12 noted in FIG. 9 above.
Figure 13:
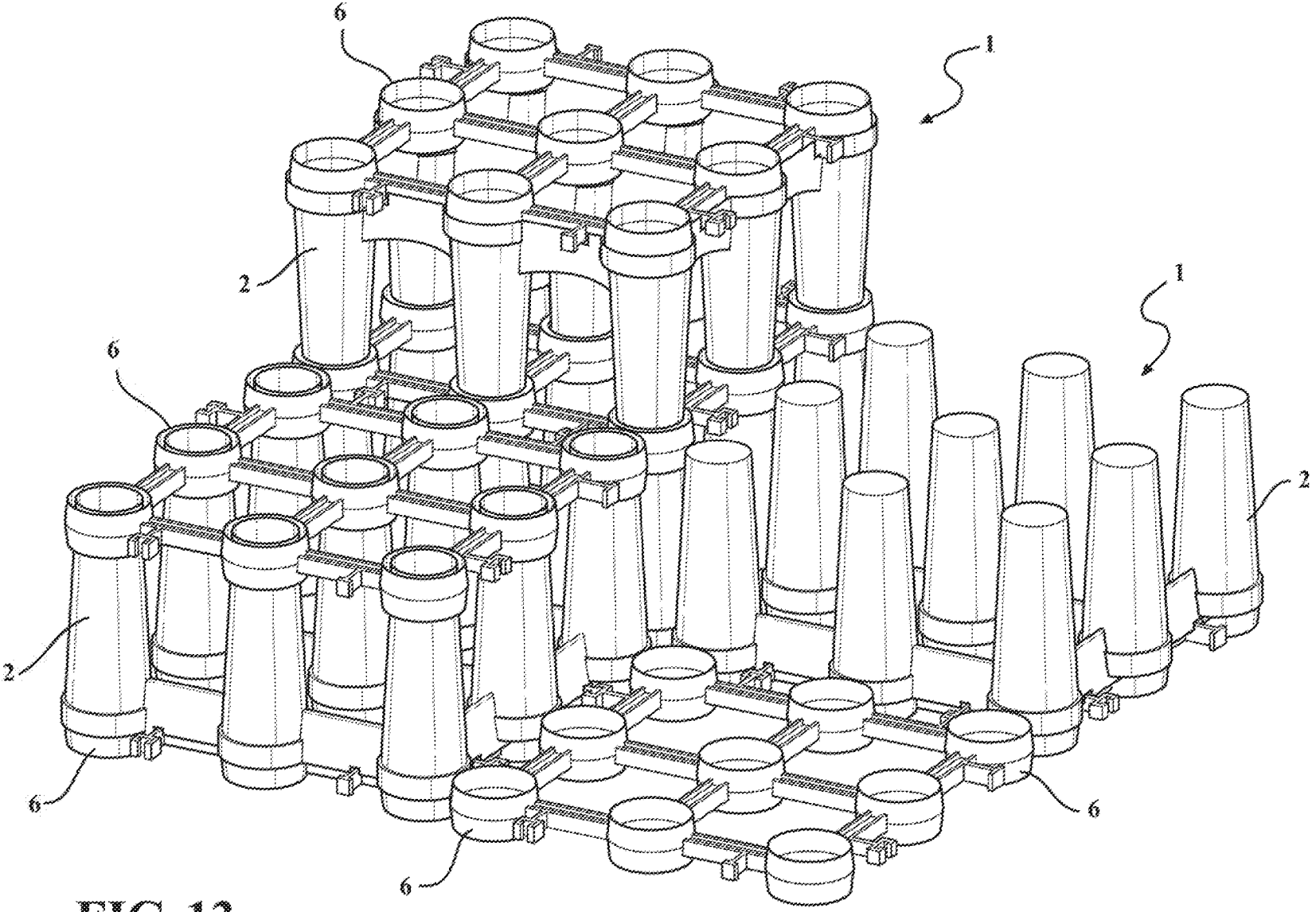
FIG. 13 illustrates a perspective view from above of an alternative part assembled matrix.
Figure 14A:
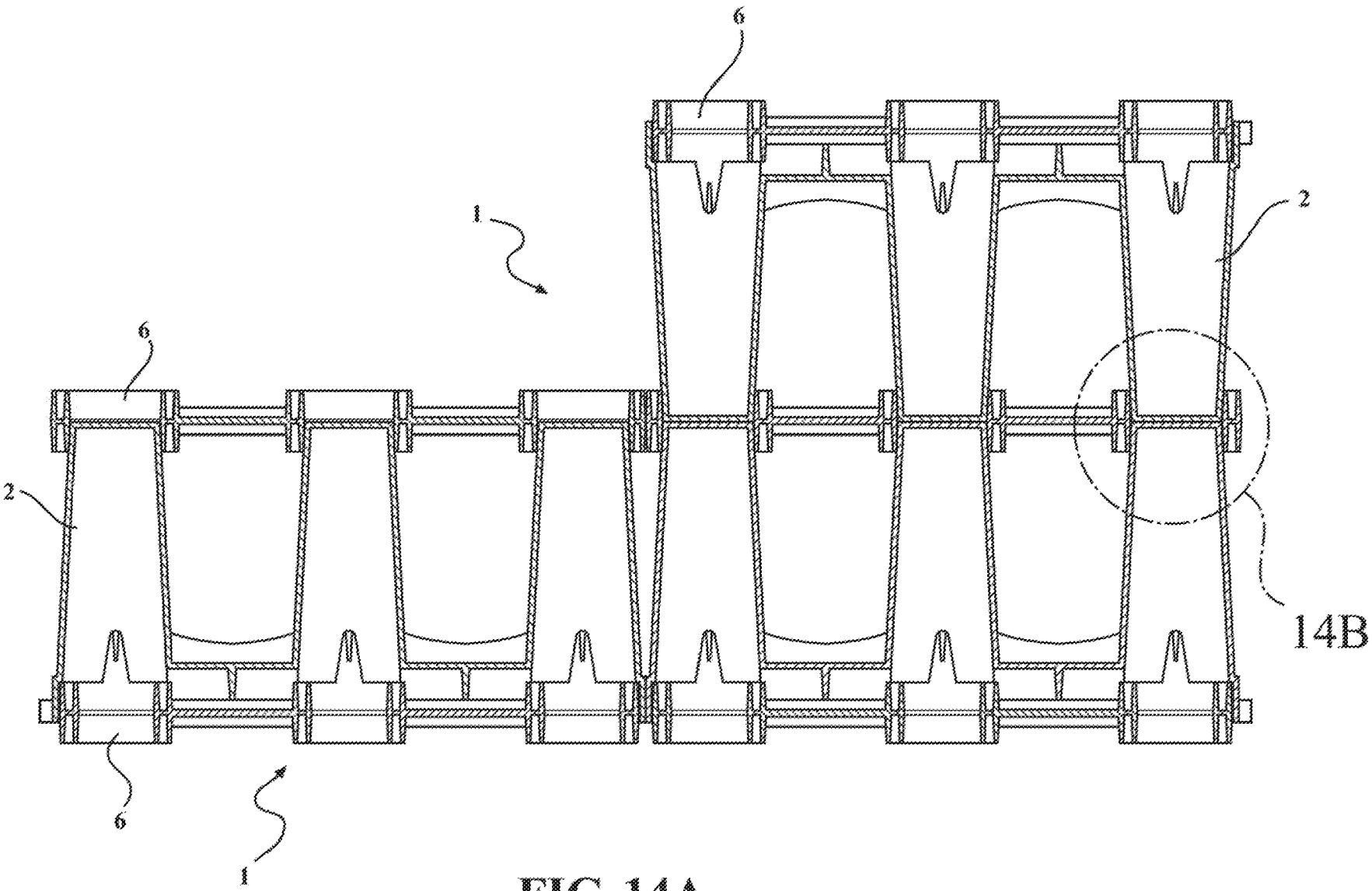

In a further alternative, best illustrated in FIGS. 9, 10 and 13, structural cells 1 stacked on one another may alternate in orientation. For example, a first structural cell 1 may be laid onto a substrate or separate plate 6 frame 3 side down with the legs 2 extending vertically upwards. A second structural cell 1 may then be placed onto the first structural cell 1, the second structural cell 1 terminal leg 2 ends 5 abutting and aligning with the first structural cell 1 terminal leg 2 ends and the second structural cell 1 then finishing at a highest point about the structural cell 1 frame 3.

Figure 7:
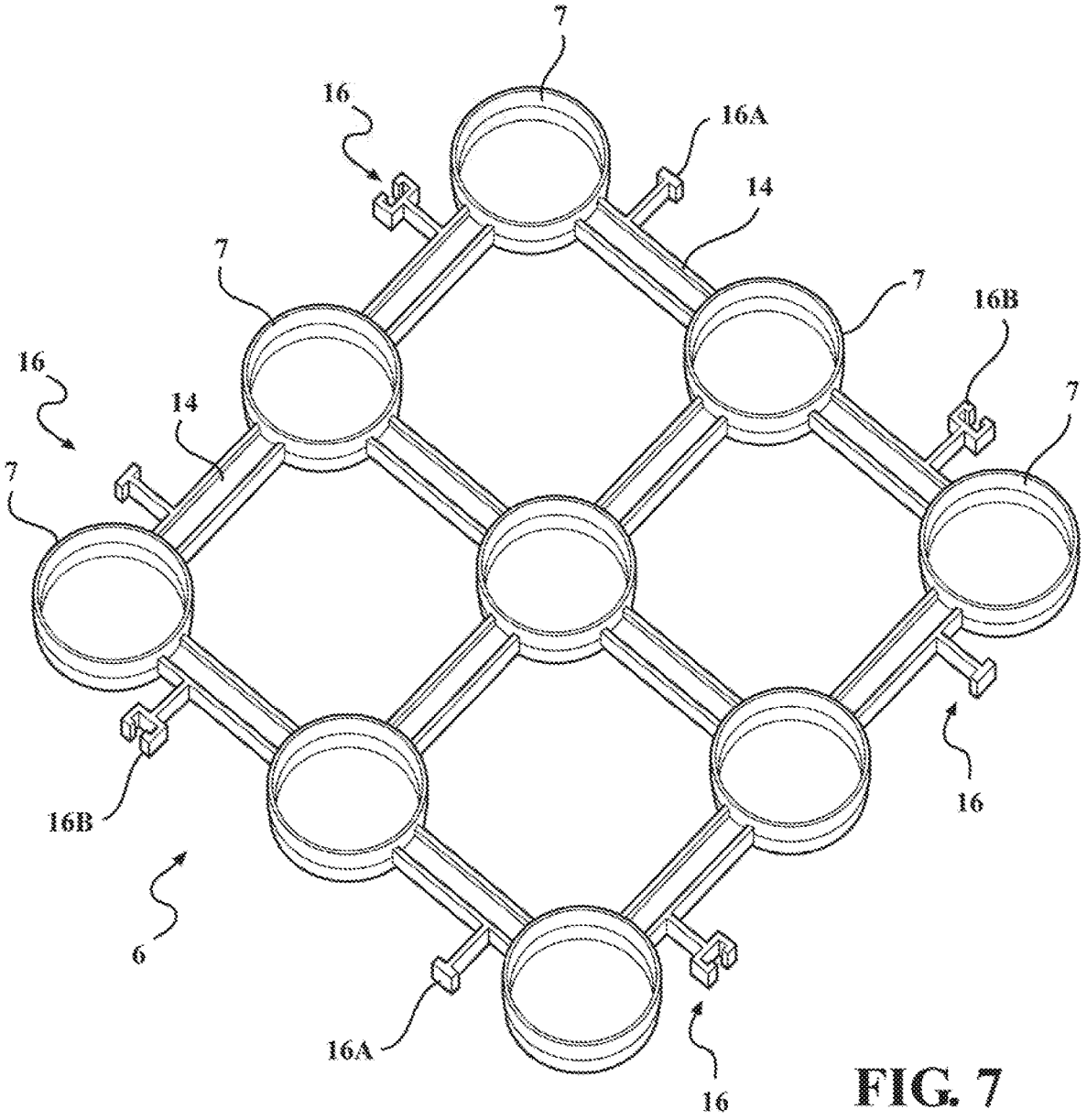
FIG. 7 illustrates a perspective view of a separate frame.
Figure 11:
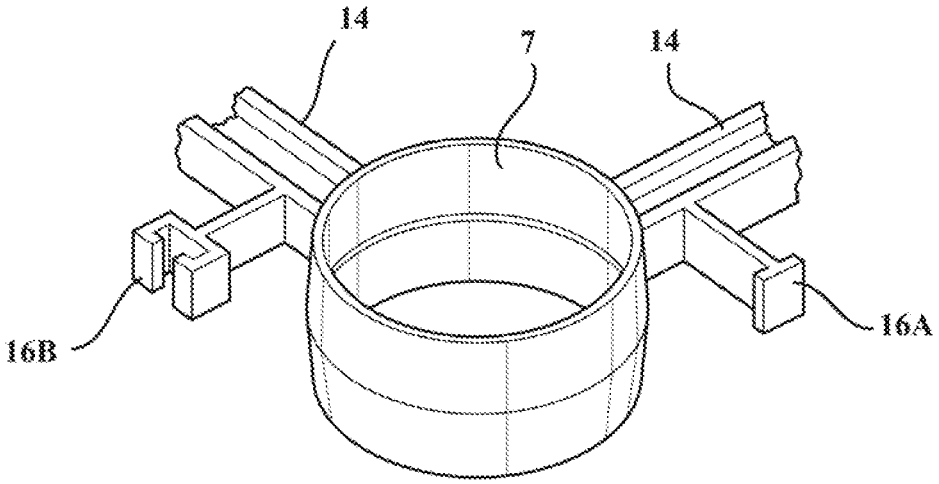
FIG. 11 illustrates detail 11 noted in FIG. 10 above.

The separate plate 6 shown in various Figures but specifically in FIG. 7 and FIG. 11 has lateral supports 14 may be ribbed elongated members. The plate 6 lateral supports 14 may have a U-shaped or H-shaped cross section best seen in FIG. 7. Each plate 6 lateral support 14 is linear and straight along the support 14 elongated length.

The plate 6 sockets 7 (and free sockets 8) may have a cross-sectional shape that substantially complements and snugly fits the shape of the terminal end 5 of each leg 2 and/or the shape of the frame 3 end 4 of each leg 2.

The plate sockets 7 and free sockets 8 have substantially similar shapes, the shape best seen in FIG. 6 (a free socket 8 is shown however the only difference is the presence of plate lateral supports in the plate socket 7). Each socket 7, 8 is collar shaped with a substantially circular cross-section. The socket 7, 8 collar height may be approximately 25-75%, or 40-60%, or approximately 50% that of the leg 2 terminal end 5 diameter.

The socket 7, 8 collar height may be approximately 25-75%, or 40-60%, or approximately 50% that of the leg 2 frame 3 end 4 diameter.

Each plate 6 socket 7 or free socket 8 fits to the frame 3 as a snug male fitting partly into the top female side of an opening in the frame 3 end 4 of a leg 2 in a first cell 1. Alternatively, the opposing terminal end of a leg 2 in a second cell 1 may fit as a male fitting into the opening (female side) of the plate 6 socket 7 or free socket 8. Reverse male/female configurations to the above may also be used.

The socket 7, 8 collar may have frustroconical interior walls that allow the leg 2 terminal end 5 and/or leg frame end 4 to mate snugly with the socket 7, 8 collar interior or exterior walls depending on the male/female orientation used.

Each socket 7, 8 collar may be formed in two halves best seen in FIG. 6 for example comprising:

- a first female half 9 with frustroconical interior walls cambered so as to move from a wider opening diameter to a narrower mid-diameter and;
- a second male half 10 with frustroconical exterior walls cambered so as to move from a narrower opening diameter to a wider mid-diameter.

The internal mid-point between the socket 7, 8 halves may include a shoulder or narrowed diameter rib 15. The shoulder may run fully around the interior circumference of the socket 7, 8.

Figure 8A:
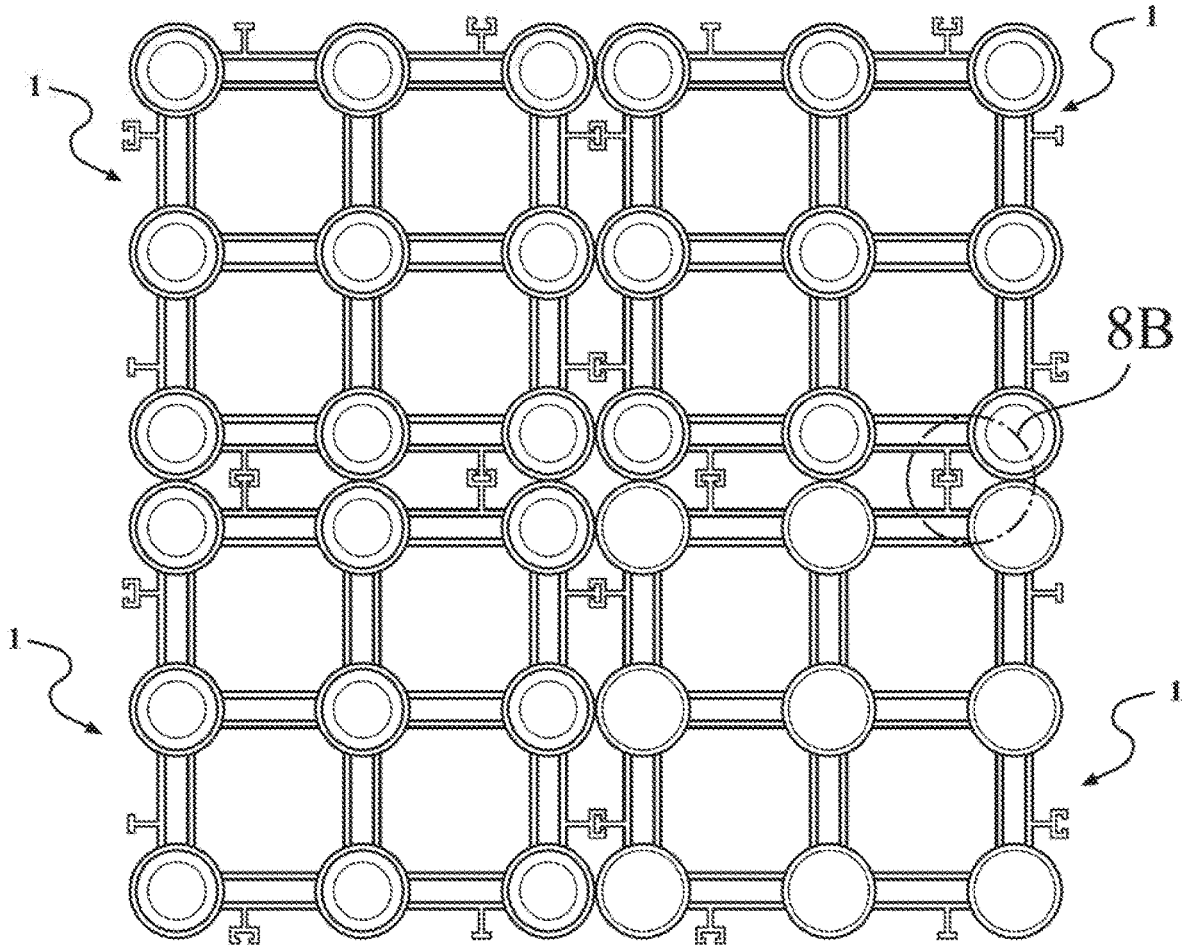
FIG. 8A illustrates a plan view of a matrix comprising four 3×3 frame and leg units and a detail view 8B.
Figure 8B:
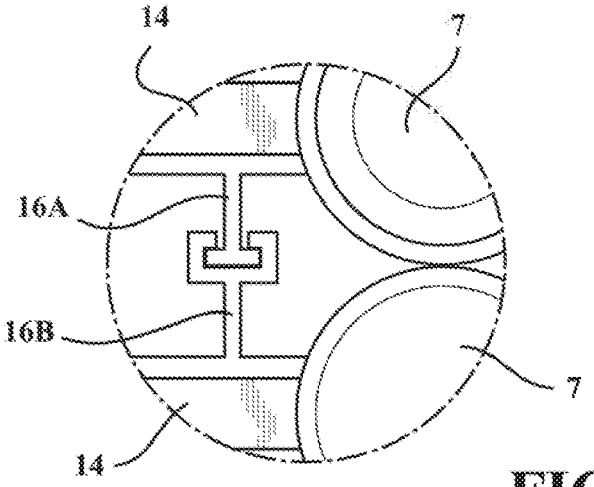

As best seen in FIG. 7 and Detail D of FIG. 8, the separate plate 6 also comprises lateral connectors 16. The lateral connectors 16 are used to link multiple plates 6 across a common (e.g. horizontal) plane. When used with the structural cell 1 described above, the separate plates 6 may be used to provide a cell matrix with horizontal plane stability acting to align the cells 1.

The lateral connectors 16 extend orthogonally from the separate plate 6 perimeter about a plane defined by the separate plate 6 planar face.

The separate plate 6 lateral connectors 16 are moulded with the separate plate 6.

Each lateral connector 16 terminates about the widest point of each plate 6 socket 7 so that the lateral connector 16 ending is approximately level with a separate plate 6 edge defined by the maximum socket 7 outer face position marked X in FIG. 7.

Each lateral connector may terminate with either a T-shaped member 16A or a C-shaped member 16B, the T-shape 16A and C-shape 16B substantially complementing each other so as to join together when fitted together.

In one embodiment, the separate frame 6 may comprise a 3×3 socket 7 square shape and each outward facing plate 6 lateral support 14 comprises a lateral connector 16 extending therefrom. In this embodiment, the terminal end 16A, 16B of each lateral connector 16 may alternate between a T-shaped ending 16A and a C-shaped ending 16B on a first separate plate 6 so as to complement alternating T-shaped 16A or C-shaped 16B endings of a further separate plate 6 located alongside the first separate plate 6.

The lateral connectors 16 may instead or in addition be located on the cell 1 frame 3 (not shown). In this embodiment, the lateral connectors 16 may extend from the frame 3 frame end 4 outwardly to allow direct connection between cells 1.

The materials used to produce the structural cell 1, separate plate 6 and free sockets 8 if used shown in the Figures may be plastic although other materials may be used.

As may be appreciated, the Figures illustrate a structural cell 1 that may be regarded as being a preformed formwork cell ready to receive concrete therein, this in the main being due to the presence of hollows 13 in the frame and legs that are open at the frame end to receive and retain concrete poured therein. The structural cells shown could instead be closed with no hollows 13 for example and the embodiments shown in the Figures should not be seen as limiting.

In an alternative embodiment not shown, the structural cell may be formed as one element from hardened concrete for placement below a hardscape. The concrete structural cell may take on the form provided by the structural cell 1 prescribed by the form work shown in the Figures, the resulting concrete cell having a plurality of solid concrete legs linked to a concrete frame at a first frame end, the concrete frame defining a generally flat plane with the legs extending substantially orthogonally away from the concrete frame plane to a concrete leg terminal ending; and wherein the concrete cell defines a free void space therein defined by the concrete frame width and depth and the leg height less any space used within this volume for the legs or frame parts.

Pouring of the concrete if used into the structural cell 1 may occur in situ at or about the final structural cell 1 or concrete cell (not shown) position.

As should be appreciated, the concrete cells noted may also be arranged to form matrices such as those illustrated in FIG. 1, FIG. 2, FIG. 9, FIG. 10 and FIG. 13.

The legs 2 of one structural cell 1 in a matrix may substantially align with the legs 2 of a second and subsequent vertically stacked structural cell 1 so as to provide a common transfer of compressive load down a single leg 2 column from the top of a cell 1 matrix to the bottom of the cell 1 matrix. That is, there is a continuous alignment of the legs 2 and transfer of compressive load across successive structural cells 1.

Openings in the free void space of the matrix may be substantially continuous from top to bottom or side to side of the matrix. That is, the openings in the free void space of one structural cell may substantially align with the openings in any additional structural cells 1 used.

A matrix may be rapidly assembled as follows:

1. Excavate a pit in which the matrix is to be formed and optionally line the pit base and/or sides with a permeable or non-permeable layer;
2. Place separate plates 6 on the pit base substrate, linking the separate plates 6 together via the lateral connectors 16;
3. Place a first layer of structural cells 1 on the separate plates 6 aligning and fitting together the structural cell 1 leg 2 terminal ends 5 or frame ends 4 depending on the structural cell 1 orientation (frame 3 side up or down) with the separate plate 6 sockets 7;
4. Repeat fitting structural cell 1 layers until the desired matrix height is reached optionally including further intermediate separate plates 6 between the structural cell 1 layers or including free sockets 8 between the structural cell 1 layers;
5. Place separate plates 6 on top of the final structural cell 1 layer, linking the separate plates 6 together via the at least one lateral connector 16; and
6. Placing a hardscape on the matrix.

Where a concrete is used, the concrete may be poured into the at least one structural cell 1 during matrix assembly, for example as each structural cell layer is fitted or once the whole matrix is assembled, the concrete being poured through the top most separate plate 6 sockets 7 and running down each cell 1 layer assuming openings are present, usually between the structural cell 1 legs 2 to allow flow of concrete across multiple structural cell 1 layers.

Aspects of the structural cells, matrices and methods of assembly have been described by way of example only and it should be appreciated that modifications and additions may be made thereto without departing from the scope of the claims herein.

What is claimed is:

1. A structural cell assembly, the assembly comprising:

a structural cell with a plurality of legs integrally linked to a frame at a frame end, said frame linking said legs together and said frame defining a generally flat plane with said legs extending substantially orthogonally away from said frame end about said frame flat plane to a leg terminal end; and a separate plate engaging the legs, said separate plate comprising:

a plurality of linked sockets, each of said sockets engaging said leg terminal end; and/or a plurality of linked sockets, each of said sockets engaging said frame ends or a part thereof;

wherein said frame links said legs together via lateral supports located about said frame end with said frame defining a free void space between said lateral supports and said legs with said free void space being continuous and not segmented.

2. The structural cell assembly according to claim 1 wherein an overall structural cell volume is defined by a free void space, an internal void space and a portion of structural cell material, wherein:

said free void space includes at least 75% of said overall structural cell volume, said free void space being defined by a frame width and depth and a leg height less any space used within said free void space for said legs or said frame and said internal volume defined by said legs and said frame; and said internal void space of said structural cell comprises approximately 1-25% of said overall structural cell volume, said internal void space being defined by any volume of space within said legs or said frame not accessible from said free void space.

3. The structural cell assembly according to claim 1 wherein said structural cell includes a plurality of legs, each having a generally a frustoconical shape, arranged relative to each other in regular or even patterns that collectively spread a compressive load placed thereon.

4. The structural cell assembly according to claim 1 wherein said legs are hollow and at least partially open at: a leg frame end; a leg terminal end; or both said leg frame end and said leg terminal end.

5. The structural cell assembly according to claim 1 wherein said lateral supports, said frame end surrounds and said legs collectively define a common hollow, said common hollow defining an internal void space configured to receive and retain a structural fluid with said internal void space being continuous and not segmented.

6. The structural cell assembly according to claim 2 wherein a hardened structural fluid is poured in and retained within said internal void space.

7. The structural cell assembly according to claim 6 wherein said hardened structural fluid is concrete.

8. The structural cell assembly according to claim 6 wherein said structural cell has a compression strength in excess of 300 kPa.

9. A load bearing matrix comprising:

a plurality of structural cells aligned vertically and/or horizontally; and a plurality of separate plates, each of said separate plate having approximately same width and length as each of said structural cell, said separate plates located on top of said structural cells and/or below said structural cells; and wherein each structural cell comprises a plurality of legs integrally linked to a frame at a frame end, said frame defining a generally flat plane with said legs extending orthogonally away from said frame end to a leg terminal end;

wherein each separate plate comprises plate sockets linked together via lateral connectors, located about said leg frame end with said frame defining a free void space between said lateral supports and said legs with said free void space being continuous and not segmented, that engage with either an opening in said frame end of a first structural cell, or said leg terminal end of a second structural cell.

10. The load bearing matrix according to claim 9 wherein the overall matrix volume is defined by a free void space, an internal void space and a portion of structural cell material itself, wherein:

said free void space includes at least 75% of said overall structural cell volume, said free void space being defined by a frame width and depth and a leg height less any space used within said free void space for said legs or said frame and said internal volume defined by said legs and said frame; and said internal void space of said structural cell comprises approximately 1-25% of said overall structural cell volume, said internal void space being defined by any volume of space within said legs or said frame not accessible from said free void space.

11. The load bearing matrix according to claim 9 wherein said structural cells are aligned vertically with each of said frame of said structural cell being located above said legs.

12. The load bearing matrix according to claim 9 wherein said structural cells are aligned vertically with each of said frame of said structural cell alternating in orientation from a first layer of said structural cells in a frame located below said legs configuration to a second layer of said structural cells in a frame located above said legs configuration and optionally, further alternating layers following the same alternating arrangement.

13. The load bearing matrix according to claim 9 wherein each of said plate socket, when fitted to said frame, fits as a snug male fitting partly into a top female side of an opening in said frame end of said first structural cell and said opposing leg terminal end of said second structural cell fits as a male fitting into said opening female side of said plate socket.

14. The load bearing matrix according to claim 9 wherein each of said separate plate has at least one lateral connector used to link multiple plates across a common horizontal plane.

15. The load bearing matrix according to claim 14 wherein said at least one lateral connector connects abutting structural cells together, said lateral connectors having a shape and form that enables said legs in the matrix to be substantially equidistant to one other.

16. The load bearing matrix according to claim 9 wherein the matrix further comprises at least one free socket placed intermediate vertical spaced structural cells, said free socket linking together an opening in said leg frame end in said first structural cell with said leg terminal end of said second structural cell.

* * * * *